US008514078B2

(12) United States Patent
Lax et al.

(10) Patent No.: US 8,514,078 B2
(45) **Date of Patent: *Aug. 20, 2013**

(54) ANTI-THEFT SECURITY DEVICE AND PERIMETER DETECTION SYSTEM

(75) Inventors: Michael R. Lax, Westbury, NY (US); Agjah Libohova, Westbury, NY (US); Frederic van Koot, Halesite, NY (US)

(73) Assignee: Autronic Plastics, Inc., Westbury, NY (US)

( * ) Notice: Subject to any disclaimer, the term of this patent is extended or adjusted under 35 U.S.C. 154(b) by 366 days.

This patent is subject to a terminal disclaimer.

(21) Appl. No.: 12/685,473

(22) Filed: Jan. 11, 2010

(65) Prior Publication Data

US 2010/0134295 A1 Jun. 3, 2010

Related U.S. Application Data

(63) Continuation of application No. 11/496,054, filed on Jul. 27, 2006, now Pat. No. 7,671,741.

(60) Provisional application No. 60/784,820, filed on Mar. 21, 2006, provisional application No. 60/711,208, filed on Aug. 24, 2005, provisional application No. 60/703,122, filed on Jul. 27, 2005.

(51) Int. Cl.
*G08B 13/14* (2006.01)

(52) U.S. Cl.
USPC ..... 340/572.1; 340/572.4; 340/572.7; 340/572.8; 340/5.9; 340/10.1; 340/540; 340/541; 340/568.2; 340/568.4; 235/382; 235/385; 235/492

(58) Field of Classification Search
USPC ..... 340/572.1, 572.44, 572.7, 572.8, 340/5.9, 10.1, 540, 541, 568.2, 568.4; 235/382, 235/385, 492
See application file for complete search history.

(56) References Cited

U.S. PATENT DOCUMENTS 3,932,857 A * 1/1976 Way et al. ..... 340/568.2
4,774,503 A 9/1988 Bussard
5,072,213 A * 12/1991 Close ..... 340/568.2

(Continued)

FOREIGN PATENT DOCUMENTS

GB 2 287 339 9/1995
GB 2 310 977 9/1997

OTHER PUBLICATIONS

International Search Report dated Feb. 6, 2008.

*Primary Examiner* — Tai T Nguyen
(74) *Attorney, Agent, or Firm* — Zollinger & Burleson Ltd.

(57) ABSTRACT

A security tag in accordance with an embodiment of the present invention includes a housing, a membrane operable for attachment to merchandise, wherein the housing is connected the membrane, a monitoring device operable to monitor whether a party removes or attempts to remove the housing from the membrane and an alarm operable to emit a tamper signal when the monitoring device indicates that a party has removed or attempted to remove the housing from the membrane in an unauthorized condition. A security system in accordance with an embodiment of the present invention includes a security tag operable for connection to merchandise to be secured, a monitoring device operable to monitor whether a party removes or attempts to remove the security tag from the merchandise and an alarm operable to emit a tamper alarm signal when the monitoring device indicates that a party has removed or attempted to remove the security tag from the merchandise in an unauthorized condition.

17 Claims, 30 Drawing Sheets

(56) References Cited

U.S. PATENT DOCUMENTS

| | | | | |
|---|---|---|---|---|
| 5,245,317 | A * | 9/1993 | Chidley et al. | 340/571 |
| 5,898,370 | A | 4/1999 | Reymond | |
| 5,963,131 | A | 10/1999 | D'Angelo et al. | |
| 6,078,258 | A | 6/2000 | Auerbach et al. | |
| 6,137,414 | A | 10/2000 | Federman | |
| 6,353,389 | B1 * | 3/2002 | Matsuo | 340/571 |
| 6,515,586 | B1 | 2/2003 | Wymore | |
| 6,995,669 | B2 | 2/2006 | Morales | |
| 7,073,236 | B2 * | 7/2006 | Xue et al. | 24/704.1 |
| 7,098,792 | B1 | 8/2006 | Ahlf et al. | |
| 2002/0123932 | A1 | 9/2002 | Brenhouse | |
| 2003/0197611 | A1 | 10/2003 | Clifford | |
| 2004/0173477 | A1 | 9/2004 | Lax | |
| 2005/0104733 | A1 | 5/2005 | Campero | |

* cited by examiner

ANTI-THEFT SECURITY DEVICE AND PERIMETER DETECTION SYSTEM

CROSS REFERENCE TO RELATED APPLICATIONS

The present application is a continuation under 37 C.F.R. sctn.1.53(b) of U.S. Pat. No. 7,671 741, by Michael R. Lax et al., entitled ANTI-THEFT SECURITY DEVICE AND PERIMETER DETECTION SYSTEM, which claims benefit to and priority from U.S. Provisional Patent Application No. 60/703,122, filed Jul. 27, 2005; U.S. Provisional Patent Application No. 60/711,208, filed Aug. 24, 2005; and U.S. Provisional Patent Application No. 60/784,820, filed Mar. 21, 2006, of which the entire contents of each are hereby incorporated by reference herein.

BACKGROUND

1. Field of the Invention

The present application relates to a security tag and a security system for use therewith. More particularly the present application relates to a tamper resistant security tag and a security system utilizing a perimeter detection feature to establish warning and breach zones to help prevent theft.

2. Description of the Art

Over the years, many companies and individual retail stores have tried to increase the security of products in a retail setting while at the same time making the products sufficiently available to customers in order to encourage purchase of those products. Various approaches have been applied to preventing theft, however, all of these approaches have problems.

Perhaps the simplest approach is to lock valuable items up, in a display case, for example, and require customers to seek the assistance of store personnel in order to take a closer look at the merchandise. However, this approach makes the merchandise not readily accessible to the customer, and thus, may tend to discourage sales of the product. Further, this system does not address the problem of employee theft either, since it is the employees who have the keys to the storage cases. Thus, this system, while simple in implementation, has significant drawbacks.

Another approach is the use of surveillance cameras throughout the store to monitor activity for potential theft. However, in a large store many cameras would be necessary in order to observe all areas of the store. Many security personnel would be necessary to monitor the visual information provided by the cameras. In addition, in most stores there will still be areas that are uncovered or difficult to cover with security cameras, thus there are problems with this system as well.

Another approach is to provide a security tag that is attached to the product or its packaging that is used to trigger an alarm if the merchandise is removed from the store in an unauthorized manner. In this approach, products need not be locked up in display cases and stores need not rely exclusively on security cameras. In some cases, the security tag is a source tag, which is typically a small relatively soft security tag attached to, or placed within the packaging of the product. These tags typically trigger an alarm when they pass one or more sensors near the exit of a store. One problem with these tags is that they are typically rather small and often are hidden in, or on, the merchandise. As a result, there is no obvious visual indication of their presence. This lack of a visual deterrent may embolden potential thieves and thus encourage theft. In addition, if the source tag is detected by a thief, it is typically not difficult to remove from the merchandise.

In another approach, reusable hard tags may be attached to the merchandise and/or the packaging thereof. These tags tend to be larger than the source tags described above and thus are visible to prevent theft. In addition, these tags are also typically securely fastened to the merchandise in some manner such that they are difficult to remove. These tags typically include circuitry that emits a response signal in response to an interrogation signal transmitted near the exit of the store. The response signal is then received by receivers at the exit and an alarm sounds. However, since it is very obvious that these tags are in use, thieves commonly utilize some form of shielding to prevent the transmission of the response signal to the receivers. Typically, the response signal is a relatively low power signal and is not difficult to block. One such shielding method is the use of so called "booster bags" which are lined with a shielding material that blocks either the interrogation signal or the response thereto and thus prevents the alarm from sounding.

Another a problem with both the source tag and the hard tag is that the alarm is not triggered until the security tag and the merchandise are almost at the exit of the store. Thus, there is little or no time for security personnel in the store to react to the alarm to prevent the theft. That is, these tags do not allow any sort of intra-store tracking or security monitoring until the merchandise is already on its way out of the store.

Further, conventional security systems for use with such conventional security tags also have certain shortcoming. For example, as noted above, there is typically only one area in which the security tags trigger an alarm and this area is typically very close to the exit to the store. However, by the time the alarm is triggered, the merchandise is so close to the exit of the store, store employees have little time to react to stop the merchandise from being removed from the store. Even where stores have multiple exits and thus multiple alarm are used, the alarm is typically triggered too late for store personnel to stop the theft.

Thus, it would be desirable to provide a security tag and security system for use therewith that avoids the problems noted above.

SUMMARY

The present invention relates to security tags for use in preventing theft and a security perimeter detection system preferably for use with such security tags.

The security tags of the present invention may provide a tamper-resistant product security device. In some embodiments, the device may include a security tag (e.g., an EAS, RFID, or any other tag or security device) affixed to the outside of a consumer or retail package (or affixed directly on the product itself). This tag may be tamper-resistant. The tag may include an audible alarm, or a wireless or other alarm signal, which is generated when the tag is altered and/or tampered with. The tag may also send an alarm signal to a receiver when the tag is tampered with to trigger an external alarm or otherwise set an alarm condition.

A security tag in accordance with an embodiment of the present invention includes a housing, a membrane operable for attachment to merchandise, wherein the housing is connected the membrane, a monitoring device operable to monitor whether a party removes or attempts to remove the housing from the membrane and an alarm operable to emit a tamper signal when the monitoring device indicates that a party has removed or attempted to remove the housing from the membrane in an unauthorized condition.

A security tag in accordance with another embodiment of the present invention includes a housing, a connecting portion connected to the housing portion and operable to connect the housing to merchandise to be secured, a monitoring device operable to monitor whether a party removes or attempts to remove the housing from the connecting portion and an alarm operable to emit a tamper signal when the monitoring device indicates that a party has removed or attempted to remove the housing from the connecting portion in an unauthorized condition.

A security system in accordance with an embodiment of the present invention includes a security tag operable for connection to merchandise to be secured, a monitoring device operable to monitor whether a party removes or attempts to remove the security tag from the merchandise and an alarm operable to emit a tamper alarm signal when the monitoring device indicates that a party has removed or attempted to remove the security tag from the merchandise in an unauthorized condition.

A security system in accordance with another embodiment of the present invention includes a security tag operable for connection to merchandise to be secured, wherein the security tag includes a first element operatively connected to a second element, a monitoring device operable to monitor a relationship between the first element and the second element, and an alarm operable to emit a first alarm signal when the monitoring device indicates that the first element is separated from the second element in an unauthorized condition.

A security system in accordance with an embodiment of the present invention includes a security tag operable for connection to merchandise to be secured, wherein the security tag includes a first element operatively connected to a second element, a monitoring device operable to monitor a relationship between the first element and the second element, an alarm operable to emit a first alarm signal when the monitoring device indicates that the first element is separated from the second element in an unauthorized condition, a plurality of network readers positioned in predetermined locations, wherein each network reader has a predefined reception range and each network reader is operable to receive wireless signals including the first alarm signal and a collector connected to each network reader of the plurality of network readers and operable to receive information from the network readers regarding wireless signals received by the network readers for security processing.

DESCRIPTION OF THE EMBODIMENTS

The present application generally relates to a security tag and a security system for use therewith. The security tag is preferably attachable to merchandise to be secured and includes an alarm that will emit an alarm signal when the security tag is tampered with. In a preferred embodiment, the alarm signal is both an audible signal and a wireless signal. The audile alarm signal provides immediate notification of the tampering to store personnel nearby. The wireless signal is preferably received by one or more readers or receivers of the security system which then notify a central collector that the alarm signal has been received. Based on this information and the location of the reader that provided it, the collector can determine the location of the activated security tag and provide further information or security processing. The security system may also provide one or more emitters that emit one or more signals to activate the security tag to emit an alarm signal, a warning signal or a breach signal, when the tag is in one or more predetermined areas even if the tag has not been tampered with. Thus the security system can track a tag within one or more sections in the store.

Generally, tampering with the tag is prevented by monitoring a relationship between a first portion of the tag that is attached to the merchandise and a second portion of the tag attached to the first portion of the tag. This is preferably accomplished by monitoring an electric circuit formed between the first portion and second portion of the security tag when they are connected. When the circuit is broken, this indicates that the tag is being tampered with and results in the alarm signal being emitted by the alarm tag. To prevent unintended alarm signals from being emitted, the first portion is preferably locked to the second portion of the tag. In a preferred embodiment, this locking relationship may be engaged and/or disengaged using a magnet. The alarm is preferably deactivated by an encrypted deactivation signal prior to disengagement of the lock so that the security tag can be removed by authorized personnel.

Figure 1:
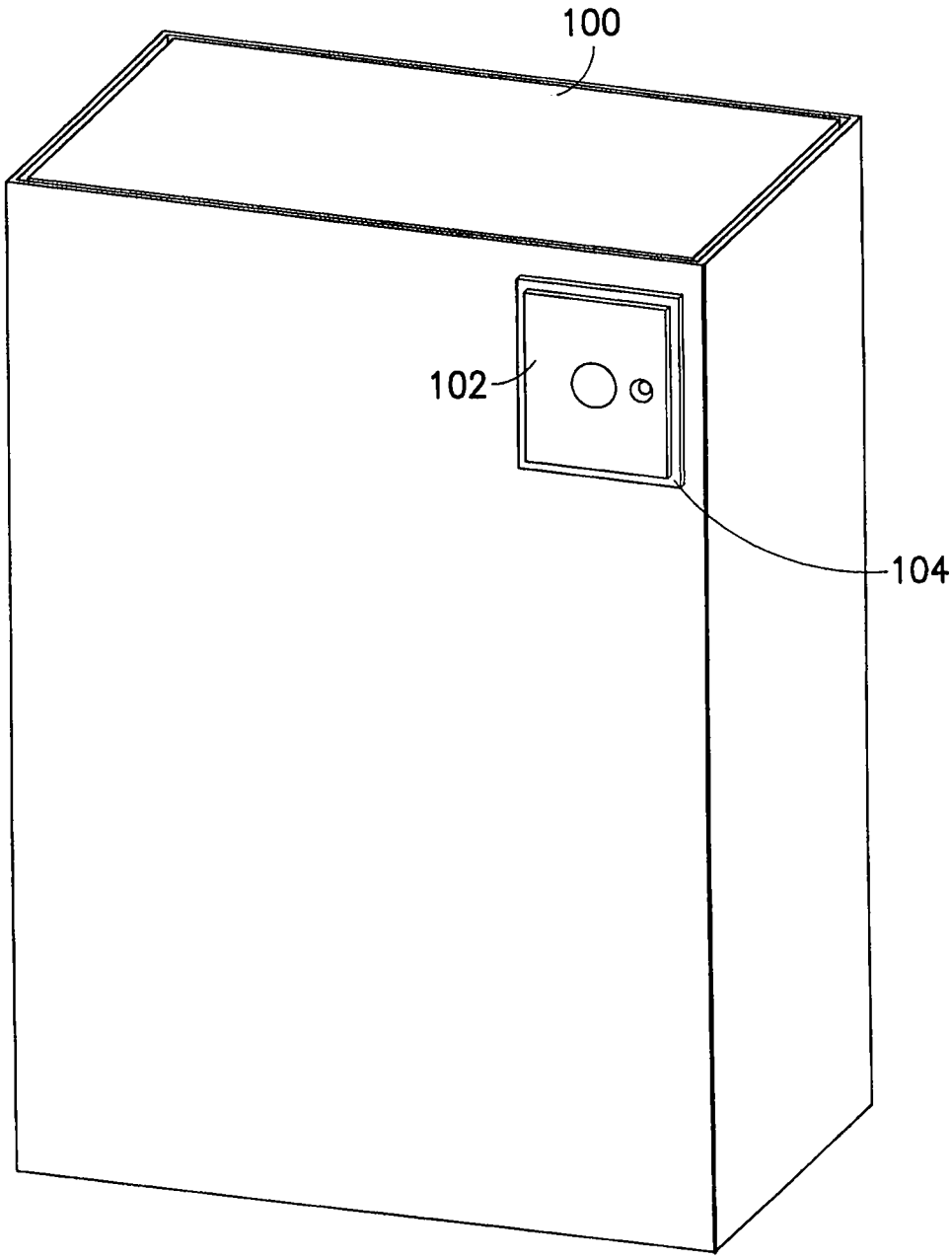
FIG. 1 is a simplified schematic diagram of an illustrative package containing a security device in accordance with the invention.
Figure 2:
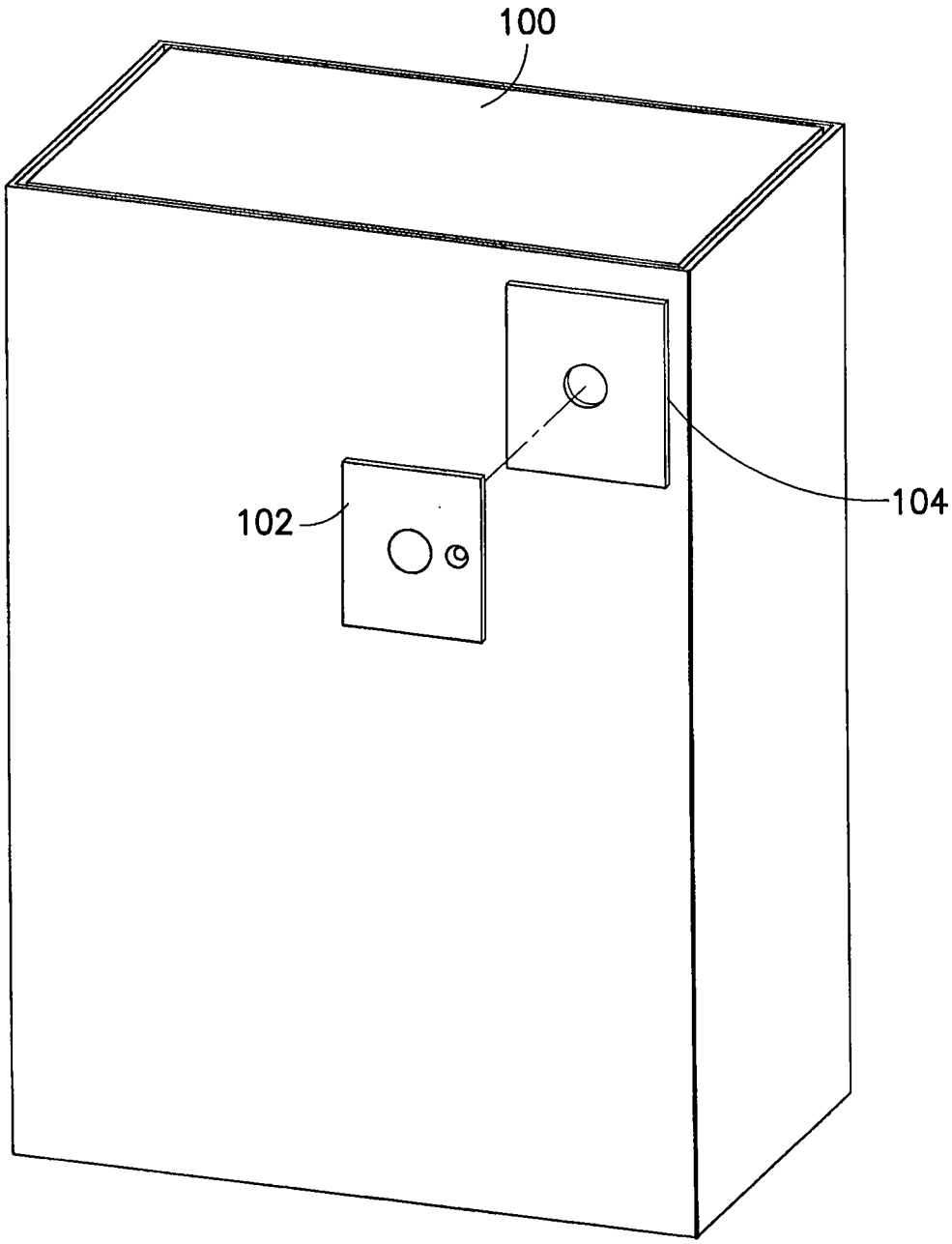
FIG. 2 is an alternate view of the illustrative package of FIG. 1 in accordance with the invention.

A specific example of a security tag in accordance with an embodiment of the present invention is explained generally with reference to FIGS. 1-2 of the present application. The security tag, or hard tag, 102 is preferably attachable to merchandise 100 within a store or other retail setting to prevent unauthorized removal or theft of the merchandise from the store. The merchandise 100 may be any product, including but not limited to consumer electronics and clothing. The merchandise need not be limited to an individual product, but can also be a package containing a plurality of products, a storage crate, shipping carton, storage container, etc.

The base membrane 104, which may also be generally referred to as the membrane portion preferably includes a pressure sensitive seal that affixes base membrane 104 to the outer package of merchandise 100. The membrane 104 may be affixed to the merchandise 100 in any appropriate manner, for example, using double-sided tape or any other appropriate adhesive. The adhesive may also be electrically conductive, if desired. Base membrane 104 may also be affixed directly to a product itself. For example, the latter arrangement may be suitable for items that traditionally do not have outer packaging (i.e. baby formula, groceries, baby strollers, etc.).

The hard tag 102 preferably includes a housing, or housing portion, 300 with a low profile (e.g., ⅛" thick or less). See FIG. 3. Housing 300 may include one or more of a battery 302, LED light 306, and an EAS/RFID tag 304. EAS/RFID tag 304 may include one or more of an EAS tag, an alarm device, an RFID tag, or any other suitable security tag or device. The EAS/RFID tag may also include a controller, such as a microprocessor for example, to control the security tag. Hard tag housing 300 may also include electronic circuitry that will match up with the conducting portion of base membrane 104 to complete a circuit. Battery 302 may power the circuit, the controller, alarm and the LED light 306, for example.

Base membrane 104 may include electronic circuitry, or otherwise include or be connected to an electrically conducting portion or element, that will match up with or otherwise connect to the housing portion 300 (See FIG. 3) of the hard tag 102 to create an electrical connection or circuit. The base membrane 104 is preferably "disposable" and may remain affixed to the merchandise 100 after checkout or purchase. The housing 300 of the hard tag 102 is preferably removed and reused after checkout and purchase.

Figure 3:
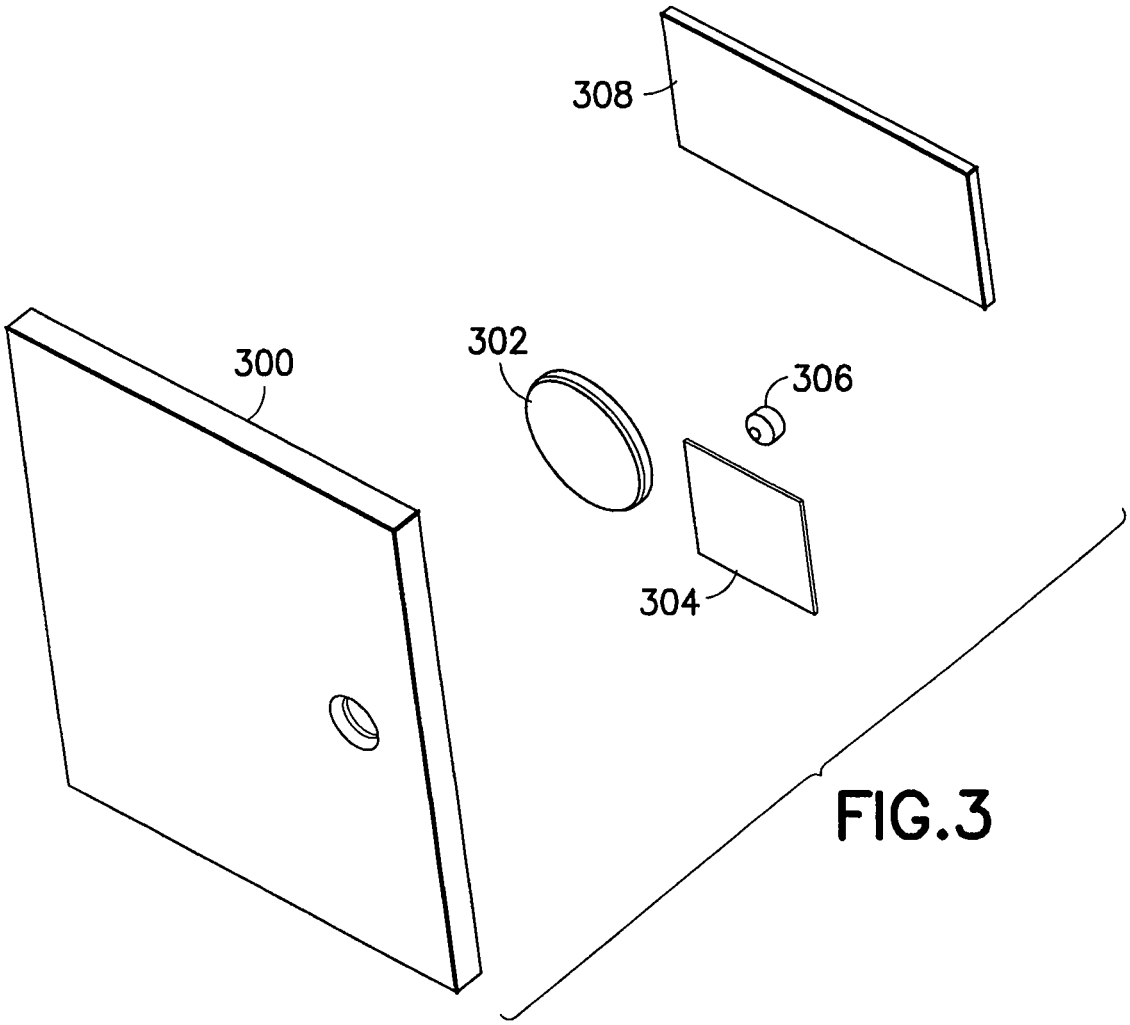
FIG. 3 is a simplified schematic diagram of an illustrative security tag in accordance with one embodiment of the invention.

In one embodiment, the tag may utilize RFID technology in conjunction with RFID readers. Thus, in this embodiment an RFID tag is included in the housing 300 as shown in FIG. 3. The RFID readers may be positioned at any convenient location throughout the retail location. For example, they may be placed at regular intervals, i.e. spaced apart every 25 feet of shelf space. For example, the network readers 612 illustrated in FIG. 6 and explained in further detail below may be RFID readers.

The security tag attached to the merchandise preferably includes tag housing 300, which may include battery 302, LED 306, EAS/RFID tag 304, and circuit board 308. The alarm is preferably incorporated into the circuit board 308 or may be incorporated onto EAS/RFID tag 304, if desired. This embodiment may include an EAS/RFID version of the housing 300. When an unauthorized person tampers with the package or asset, the circuit made when the hard tag housing 300 is attached to the base membrane 104 is broken or altered (e.g., the impedance of the circuit may change upon tampering with the device), and the active or passive RFID tag sends a signal, preferably an alarm signal, to the nearest RFID reader which may emit an audible alarm alerting store personnel to the tampering. The RFID tag may also include an audible alarm that may sound as well.

The RFID tag and/or the circuit board 308 preferably include a controller, as noted above, such as a microprocessor, or any other suitable control device that controls at least the RFID tag and the alarm. This controller and the RFID tag may alternatively be incorporated onto the circuit board 308, if desired. Alternatively, the controller may be separated from the RFID tag but connected thereto. As is commonly known by those in the art, the RFID tag may include or be connected to a transceiver (transmitter/receiver) that can transmit and receive wireless signals, such as radio frequency signals, for example. The transceiver may be incorporated into the RFID tag or separately implemented on the circuit board 308, for example. The controller is preferably utilized to control such transmission and reception of signals by the transceiver.

Figure 4:
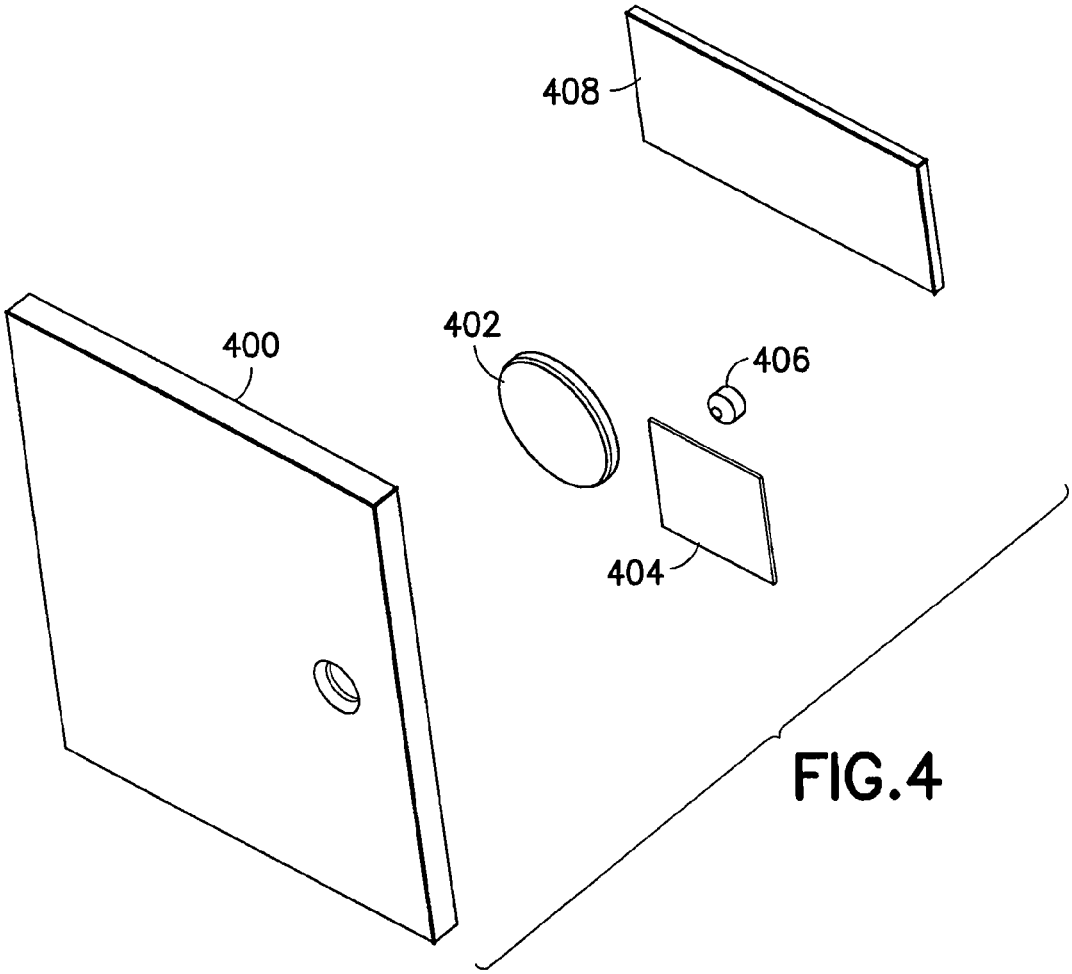
FIG. 4 is a simplified schematic diagram of an illustrative security tag in accordance with another embodiment of the invention.

In another embodiment shown in FIG. 4, the tagged asset or package may be merchandised on ordinary retail shelving. The tagged merchandise may have the EAS version of hard tag housing 400 with a circuit board with audible alarm 408. Alternatively, the audible alarm may be incorporated into the EAS tag 404, if desired. Hard tag housing 400 may also include battery 402 and LED 406. When an unauthorized person tampers with the package or asset, the housing/base membrane circuit is altered or broken, which causes the internal audible alarm to sound alerting store personnel to the tampering. The EAS tag 404 may also include a controller, such as the microprocessor mentioned above with respect to FIG. 3 that controls at least the audible alarm. The hard tag housing may also include a transceiver similar to that noted above with regard to FIG. 3 which may transmit and receive wireless signals if desired. The transceiver may be included in the EAS tag 404 or may be connected thereto. The transceiver may alternatively be included on the circuit board 408. The controller preferably also controls the transmission and receipt of such signals by the transceiver. EAS tags, such as EAS tag 404, typically are responsive to interrogation signals transmitted at or near exits of stores and emit a response signal in response to the interrogation signal. A receiver, which is often referred to as a reader, at or near the exit to the store receives the response signal and typically emits an alarm signal in response thereto to alert security personnel. As noted above, the alarm signal also preferably is an audible alarm signal as well.

When an asset or package has a security hard tag, such as hard tag 102 affixed thereto, any unauthorized tampering with the security device or tag will result in an audible alarm (either self-contained or external) alerting store personnel to help reduce theft and product shrinkage. Alternatively, or in addition, the alarm signal may be a wireless signal transmitted by the transceiver and may be received by one or more receivers or readers within the store.

Alternatively, a ribbon film or wrap (not shown) may be positioned between base membrane 104 and housing of the hard tag housing 300, or incorporated into the base membrane as part of a conducting portion thereof. The film or wrap is preferably made of a conductive material. Upon tampering with the film or wrap, the continuity of the electrical circuit between base membrane 104 and hard tag 102 may be altered, which may result in the audible alarm described above, or otherwise signal an alarm condition. This film or wrap may wrap or cover all or part of merchandise 100. In this manner, where merchandise is packaged in a box, for example, the film or wrap can be wrapped around the box such that the box cannot be opened without breaking or removing the film or wrap. If the film or wrap is removed or tampered with, the alarm will sound to indicate that the merchandise is being tampered with. That is, the film or wrap is preferably made of a conductive material, such that breaking or cutting the film or wrap disrupts the circuit between the hard tag 102 and the base membrane 104. Alternatively, a single band of conducting tape may be wrapped around the merchandise such that breaking the tape will result in the alarm sounding.

Naturally, the housing 300 of the hard tag 102 may vary in size, however, as noted above it is preferable that the housing 300 has a relatively low profile. The EAS/RFID tag 304 included in the housing preferably includes one or more of an EAS tag, an alarm device, an active or passive RFID transceiver, or other transceiver and any or suitable security tag or device. Housing portion 300 may also include electronic circuitry, on circuit board 308, for example, that will match up with or otherwise interact with the base membrane 104 to create a circuit. Battery 302 may power the circuit and LED light 306 and the alarm and/or transceiver, if desired. LED light 306 may be bimodal (red and green), continuous, or exhibit a pulsed illumination, such as a "heartbeat" pulse. In one embodiment, bimodal LED light 306 is red when armed and green when disarmed. Naturally, other variations may be used to illustrate the status of the tag using the LED. In addition, as noted above a controller (not shown) may be provided to control the alarm, the transceiver and the LED if desired.

The circuit formed between the housing 300 and the membrane 104, for example, serves as a monitoring device to monitor the connection between the housing and the membrane. If the circuit is broken, this indicates that the housing and/or membrane have been tampered with. As a result the alarm sounds to provide an indication of the tampering. More specifically, the controller preferably monitors the circuit between the housing and the membrane. If this circuit is interrupted without authorization, the controller controls the alarm to emit the alarm signal.

The transceiver discussed above is preferably utilized to communicate with, that is, send signals to and receive signals from one or more readers, emitters or transceivers positioned throughout the store for example. These readers, emitters and/or transceivers are preferably interconnected with an intra-store communications network, including a central collector that may be utilized to alert security personnel of the reception of an alarm signal and a location of the alarm signal. This embodiment is described in further detail below As noted above, when an unauthorized person tampers with the package or asset, the housing/membrane circuit may be altered or broken, which may cause the internal audible alarm to sound and thus alert store personnel to the tampering. In some embodiments, both an internal audible alarm sounds and a wireless signal is transmitted to the network readers (See FIG. 6, for example) when a tag is breached or the electrical circuit between the base membrane and housing is altered.

In this way, when an asset or package has the security tag affixed, any unauthorized tampering with the security tag will result in an alarm (either a self-contained audible alarm, an external audible alarm, or a wireless signal notification to a back-end communication network or collector) alerting store personnel to help reduce theft and product shrinkage.

Figure 5:
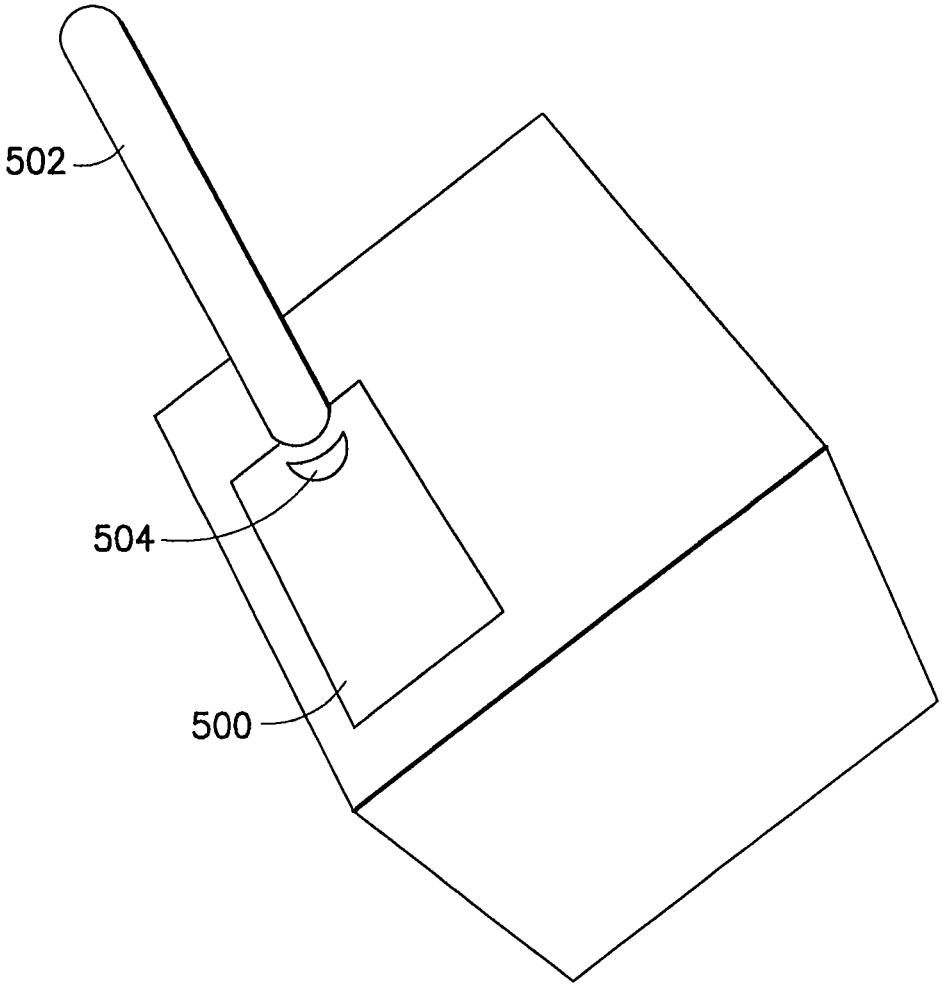
FIG. 5 is a simplified schematic diagram of an illustrative security tag and optical removal wand in accordance with one embodiment of the invention.

In some embodiments of the invention, a cashier may use a device such as a wand, or pen, during the checkout process to separate housing 300 from the base membrane 104. For example, as illustrated in FIG. 5 and explained in further detail below, the wand 502 may be used by authorized personnel to deactivate the alarm, preferably via an encrypted deactivation signal, and to separate the housing of the tag 500 from a base membrane such as base membrane 104 attached to the merchandise 100. In another embodiment, illustrated in FIG. 8D and explained in detail below, pen 810 may similarly be used to deactivate the alarm and separate the housing of the hard tag 802 from the base membrane 104.

The wand of FIG. 5, for example, may be counter-mounted or handheld for easy access. The wand may generate a suitable signal, a deactivation signal, for deactivating the alarm within housing 300 for example. That is, the deactivation signal is utilized to place the security tag in an authorized condition, wherein the alarm is deactivated to allow separation of the housing from the membrane without triggering the alarm. In some embodiments, the wand may include one or more features that may engage and remove housing from the base membrane 104, for example. The features may include a prong, a tine, a flange, or other like features. The wand may include a magnetic switch actuator or like mechanism for magnetically deactivating the internal audible alarm. The wand may include a simple magnet that may be used to release a locking pin in the housing 300 to allow the hard tag 102 to be separated from the membrane 104. In some embodiments, a magnetic switch actuator may remove housing 300 from the packaging merchandise.

By using the wand in a controlled way, hard tag housing 300 may be physically removed, thereby breaking any electric circuit made by base membrane 104 and housing of the hard tag 102 or hard tag housing 300. Since the wand also deactivates the alarm, however, the interruption of the circuit does not result in the alarm sounding.

Alternatively, the wand or pen may include one or more electrical contacts (see contacts 811 of FIG. 8, for example) compatible with electrical tag contacts (not shown) preferably positioned on a top surface of the housing 300, 801 of the hard tags 102, 802. When the contacts on the wand or pen contact the tag contacts, the alarm in the tag may be deactivated or turned off to allow the hard tag 102, 802 to be removed from the merchandise 100. That is, the contacts, such as contacts 811 receive an electrical deactivation signal to deactivate the alarm. It is preferred that the deactivation signal be an encrypted signal in order to discourage unauthorized attempts to duplicate the signal.

FIG. 5 illustrates a particular embodiment of a wand used to activate/deactivate the alarm. Specifically, FIG. 5 shows an illustrative optical removal wand 502. Optical removal wand 502 may include one or more of an LED, an optical fiber, or any other suitable optical transmitter or conductor. Optical removal wand 502 may be powered from an external power source. The wand may include a suitable receiver or transceiver, which itself may include a RFID tag, for automatically disabling the wand if removed from the commercial location or disconnected from the power source. In a preferred embodiment, hard tag 500 includes an optical sensor 504, which acts as a deactivation device, and may include one or more of a photoreceptor, phototransistor, or photo-electric cell, to receive an optical deactivation signal for disarming active tag 500. In accordance one embodiment, the optical wand 502 preferably uses light in the UV spectrum, in which case the tag includes a UV sensitive photoreceptor. Alternatively, the wand may use light in the infrared spectrum, in which case an IR sensitive photoreceptor should be used.

In a preferred embodiment, one or more optical arming/disarming schemes may be utilized, for example, the optical wand 502 discussed above. In one embodiment, a discrete wavelength (e.g., a narrow wavelength band) of light may be emitted by optical removal wand 502 to arm hard tag 500. A different discrete wavelength of light may be used to disarm removal wand 502. In other embodiments, a pulse sequence of light may be used to arm and disarm hard tag 500. In other embodiments, a pulse sequence of light and a discrete frequency of light are used to arm/disarm the tag. The pulse sequence of light and/or the discrete frequency of light may be fixed or variable with time. For example, for added security optical removal wand 502 may include an internal timer. This internal timer may be used to seed a random number generator that governs the discrete frequency of light or pulse sequence required to arm or disarm hard tag 500. Hard tag 500 may have a similar timer or other synchronization mechanism for determining which frequency or pulse sequence of light is valid for arming and/or disarming the tag. Thus, it is preferred that the deactivation signal is encrypted in some manner to protect the integrity of the system.

Although FIG. 5 shows an embodiment in which optical removal wand 502 is optical, other arrangements may be used without departing from the spirit of the invention. For example, the removal wand may include an audible or sonic arming/disarming mechanism. A discrete frequency of sound may be generated by the wand to arm hard tag 500 and another discrete frequency of sound may be used to disarm hard tag 500. Preferably, these frequencies are beyond the range of the human ear. The precise frequency of sound used to arm/disarm hard tag 500 may be fixed or variable, as previously described with respect to the optical arming/disarming mechanism. Further, the sound may be transmitted in a specific pattern. In this embodiment a sound receiving device is used as the deactivation device 502 in place of the photoreceptors discussed above. Other signals may also be transmitted by the removal wand to effect arming and disarming of hard tag 500. For example, an RFID signal or other wireless signal, or a magnetic field created by the removal wand may effect arming/disarming of hard tag 500.

As noted above, the wand 502 (or pen 810 of FIG. 8) may simply include one or more electrical contacts (such as contacts 811 in FIG. 8) on an end thereof. These contacts may then be positioned to come into contact with the electrical tag contacts positioned on the security tag housing 300, for example, to deactivate the security tag. In this case, the deactivation signal is still preferably an encrypted signal. In this manner, regardless of exactly how the deactivation signal is transmitted, the signal is encrypted to ensure security.

Figure 8A:
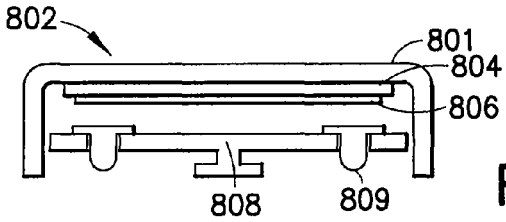
FIGS. 8A-8D illustrate cross-sections of a security tag in accordance with another embodiment of the invention.
Figure 8B:
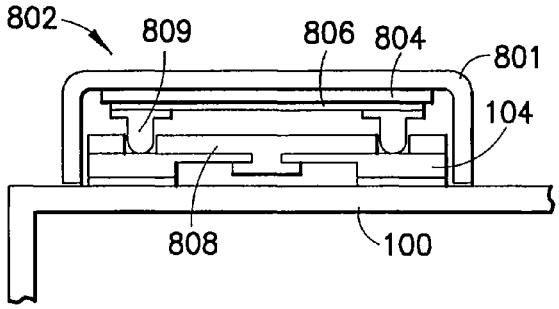
Figure 8C:
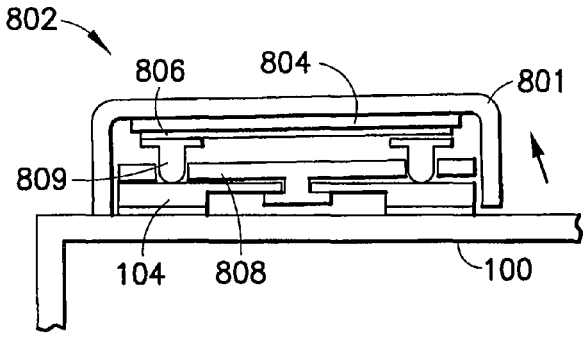
Figure 8D:
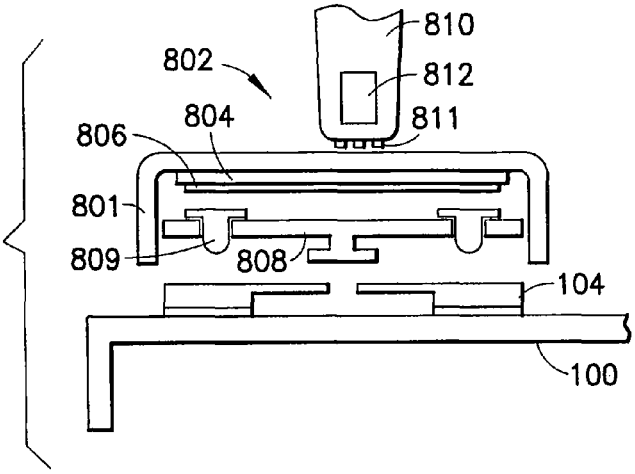

In another preferred embodiment, the wand 502 may simply include a magnet, such as magnet 812 of FIG. 8D, which preferably interacts with the security tag to allow the tag to be detached from the merchandise. Preferably, the magnet is used to move a locking pin or other locking mechanism, which is preferably made of a magnetic material, to allow the tag to be removed from the product. One example of such a wand or pen is described in further detail below with reference to FIGS. 8D and 9.

Figure 6:
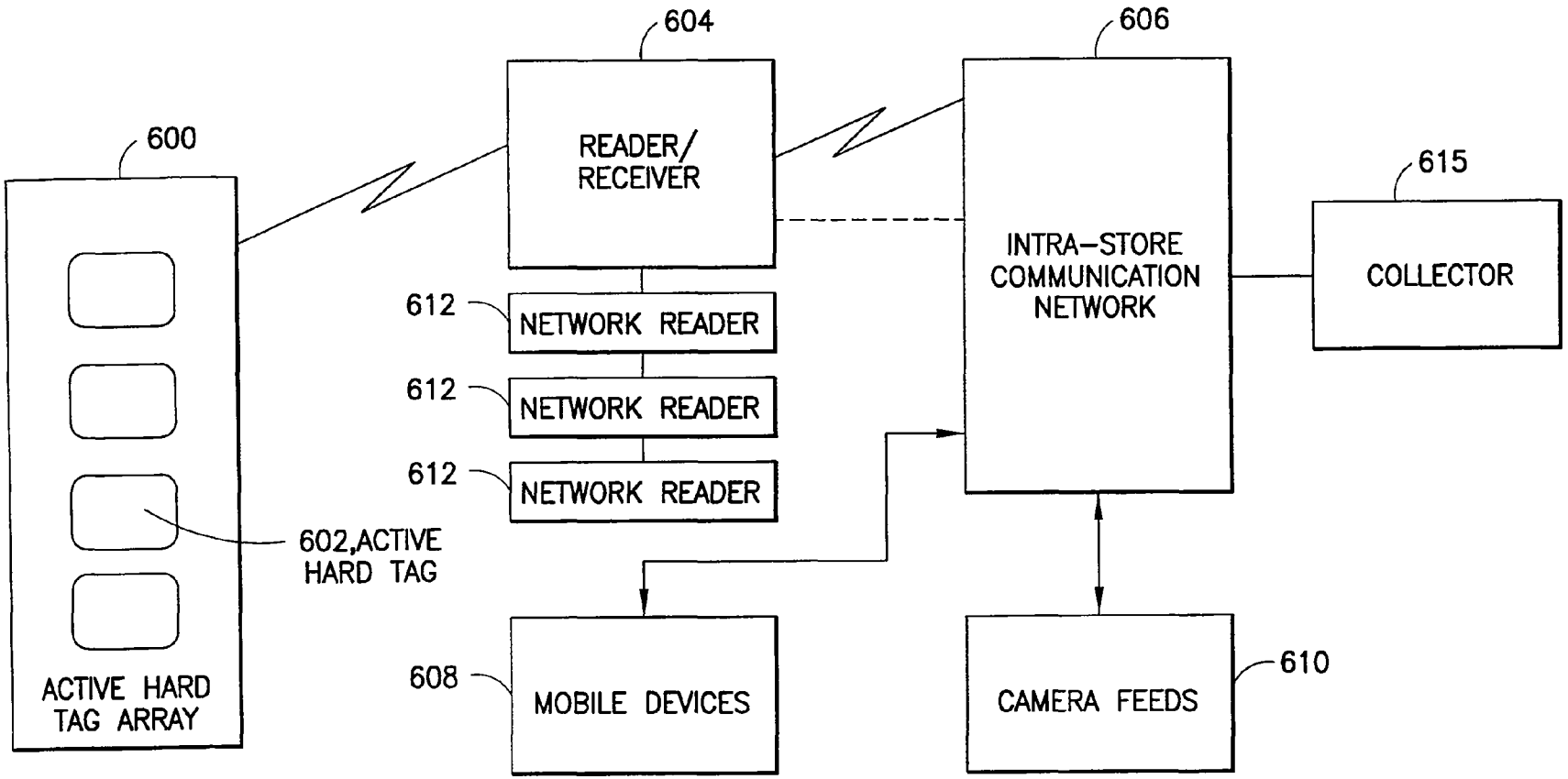
FIG. 6 is a simplified block diagram of a security tag array in communication with a communication network in accordance with another embodiment of the invention.

FIG. 6 is a simplified, illustrative block diagram illustrating a security system that may be present in some embodiments of the invention. Several active hard tags 602, similar to the hard tag 102 discussed above, may be affixed to several products in active hard tag array 600. These products may correspond to a single shelf of identical products or multiple displays of different products. Upon tampering with a tag, such as tag 602, within hard tag array 600, the tag may send an alarm signal to receiver or reader 604 indicating the tampering. The reader 604 is preferably one of the network readers 612 discussed above. Alternatively, one signal may be sent for a breach of any tag included in hard tag array 602. This signal may be sent to reader 604 via any convenient transmission, including a unicast transmission, a multicast transmission, or a broadcast transmission or any other appropriate means. The signal is preferably delivered to reader 604 wirelessly but may be delivered via a cable. Reader 604 may process the received signals and determine the originating location of the alarm breach signal. The location determination may be made using a known location of the hard tag 602 within the commercial location, or the relative strength of the received signal may be measured and the breach location may be triangulated from the strengths of multiple received signals.

Alternatively, the reception range of the reader 604 may be set such that the location of the breach may be determined simply by the location of the reader 604. Active hard tag 602 may transmit a single alarm breach signal, a continuous alarm breach signal, a periodic alarm breach signal, any combination thereof, or any other suitable signal. Active hard tag 602 may also transmit a continuous low level signal for interrogation at one or more exits of the commercial location or alternatively may respond to such an interrogation signal emitted at the exits as noted above. As active hard tag 602 passes one or more sensors, which may be located near the exits of a commercial location, or in any other defined area, the sensors may pick up the low-level interrogation signal and activate an alarm or receive a response to an interrogation signal and activate the alarm.

Reader 604 is preferably in communication with intra-store communication network 606. Preferably, each of the plurality of network readers 612 are also connected to the intra-store communication network and to each other, for example, via a powered Ethernet connection. The communication may also take place wirelessly if desired. The network readers 612 including reader 604 are preferably arranged in a daisy chain configuration as much as possible, as illustrated in FIG. 6, to simplify the network. The network readers, such as reader 604, preferably provide an alert signal if and when an alarm signal from a security tag is received. The intra-store communication network 606 preferably processes the alert signals and delivers the system alert signals to one or more devices, including mobile handsets, personal digital assistants, and computers that may be located in the network coverage area. Security personnel may be automatically notified of the breach on mobile devices 608. The intra-store communication network preferably includes at least one central collector 615, such as a personal computer or other computer system, for example, which receives the alert signals from the network readers 612 and processes them. The central collector 615 also preferably notifies the security personnel via the mobile devices as well. The collector 615 is similar to the collector 2008 described below.

In addition, camera feeds 610 from a plurality of security cameras may be automatically turned to the location of an alarm signal and supplied to intra-store communication network 606. This allows store personnel with the mobile devices 608 to automatically access live camera feeds covering the location of the alarm. Further, a recording device that records the footage obtained by the cameras may insert a bookmark or flag into the footage from the cameras to indicate that the alarm signal has been triggered.

In addition, mobile devices 608 may be sent a signal with the location of the tag breach so that an interactive application, which is preferably implemented by software on the mobile device, may map the commercial location (e.g., merchandise aisles of a retail environment) and display the breach location, that is, the location of the security tag that is emitting an alarm signal, on the mobile devices 608 for example. In one embodiment, breach locations where taping has taken place are marked with red icons within the interactive mapping application, for example. The intra-store communication system 606 may include a wireless communication device to send the messages to store employees to be received on their mobile devices as note above. Such messages may be sent in the form of e-mail messages for receipt on personal messaging devices or may be text messages for receipt on cellular telephones, for example.

Figure 7:
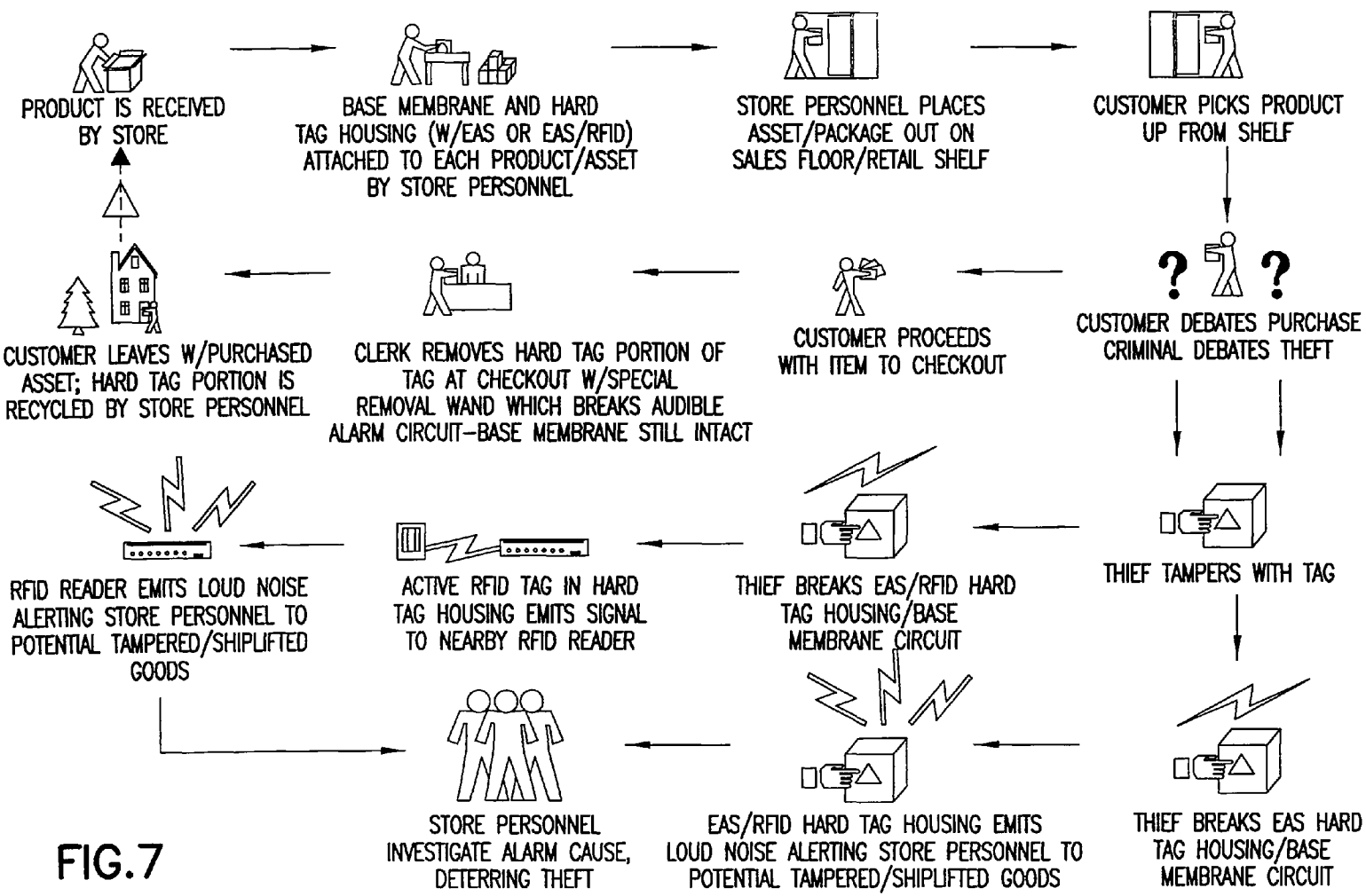
FIG. 7 is a flow diagram illustrating a typical interaction with the security tag in accordance with the invention.

FIG. 7 generally illustrates an example of a use of the security tag and system in accordance with the invention. The product to be tagged is received at a store or retail location. The product is then affixed with the security tag, such as hard tag 102, including a base membrane 104 and housing 300, for example, described above. Alternatively, the tag housing and base membrane may be affixed prior to arrival at the retail location. If a consumer decides to tamper with the security device, the circuit between the tag housing and the membrane may be broken without first deactivating or disarming the device. This causes an internally-generated audible alarm to sound and/or a signal to be sent to a nearby reader, preferably one of the network readers such as reader 604. This signal may trigger the nearby reader to transmit an alert signal to the collector via the intra-store communication network 606 for the alerting of store personnel.

A particular embodiment of a security tag 802 similar to hard tag 102 is described in further detail with reference to FIGS. 8A-8D. FIG. 8A illustrates a horizontal cross section of the security tag 802. The cover, or housing 801 preferably covers a printed circuit board (PCB) 804, with contact strip 806 attached thereto. An inner cover 808 is positioned across the bottom opening in the housing 801. Contact pins 809 extend through openings in the inner cover.

As illustrated in FIG. 8B, when the hard tag 802 is placed on base membrane 104, the pins 809 are pushed up into contact with the contact strip 806, thus completing a circuit between the housing and the base membrane 104, as described above. As illustrated, the base membrane 104 is secured to a carton of merchandise 100 via double-sided tape, for example, however, as noted above, any appropriate adhesive may be used. FIG. 8C illustrates that when the tag 802 is tampered with, the electrical contact between the base membrane and the housing 801 is interrupted, resulting in an alarm signal being generated. In particular, FIG. 8C illustrates an audible alarm, however, a wireless alarm signal may be emitted as well.

In FIG. 8D, a removal pen 810, or wand similar to optical removal wand 502 is provided to deactivate the hard tag 802. Specifically, electrical contacts 811 in the pen 810 deactivate the alarm. In particular, the contacts 811 of the pen 810 connect with the tag contacts on a top surface of the housing 801 to transmit a deactivation signal to the tag that deactivates the alarm and/or transceiver mentioned above, thus preventing emission of an alarm signal. The tag contacts are preferably connected to a controller, such as that described above and transmit a deactivation message to the controller. The controller receives the deactivation signal from the tag contacts and decrypts the signal to ensure integrity of the signal. The controller then deactivates the alarm or transceiver to prevent an alarm from being emitted. Thus, the controller acts as a deactivation device in conjunction with the tag contacts. A magnet 812 may also be provided in the pen 810 to release a locking pin used to lock the housing 801 to the membrane 104. As noted above, the base membrane 104 preferably remains on the carton of the merchandise 100.

While not specifically illustrated, the security tag 802 preferably also includes the alarm that is operable to produce the alarm signal when appropriate similar to that described above with regard to FIGS. 3 and 4, for example. The alarm may be integrated on circuit board 804. Further, the hard tag 802 preferably includes a controller to control the alarm and also includes a transceiver that is used to send and receive radio frequency or other wireless signals, preferably between the tag and one or more of the receivers or readers as noted above. The controller preferably also controls the transceiver as well. The controller and transceiver may also be integrated into circuit board 804 as well. Further, the controller is also connected to the tag contacts on the top surface of the housing 801, to receive the deactivation signal for example, from the contacts 811 of pen 810. If desired the contacts 811 may be used to send other information to the tag 802. For example, the pen 810 may be used to activate or reactivate the tag if desired. In this case an activation signal is transmitted through the contacts 811 of the pen 810 to the tag contacts on the top surface of housing 801 and preferably to the controller which then activates the alarm, for example. Further, while FIG. 8 specifically illustrates magnet 812 as a permanent magnet, the magnet 812 may be an electromagnet, powered, for example via the base station 900 described below. The controller preferably also monitors the connection between the contact pins 809 and the contact strip 806 to ensure that the circuit between the two is not interrupted.

In addition, the tag 802 of FIGS. 8A-D preferably includes a transceiver similar to that described above with respect to FIG. 3. The transceiver is preferably connected to the controller and is operable to transmit and receive wireless signals. In particular, the transceiver received warning emission signals and/or breach emission signals when in a predefined warning zone or breach zone, respectively. In response to the warning emission signal the controller may control the alarm to emit a warning alarm signal. In response to the breach emission alarm, the controller may control the alarm to emit a breach alarm signal. Both the warning alarm signal and breach alarm signal may be audible signals and or wireless signals transmitted by the transceiver, for example.

Figure 9:
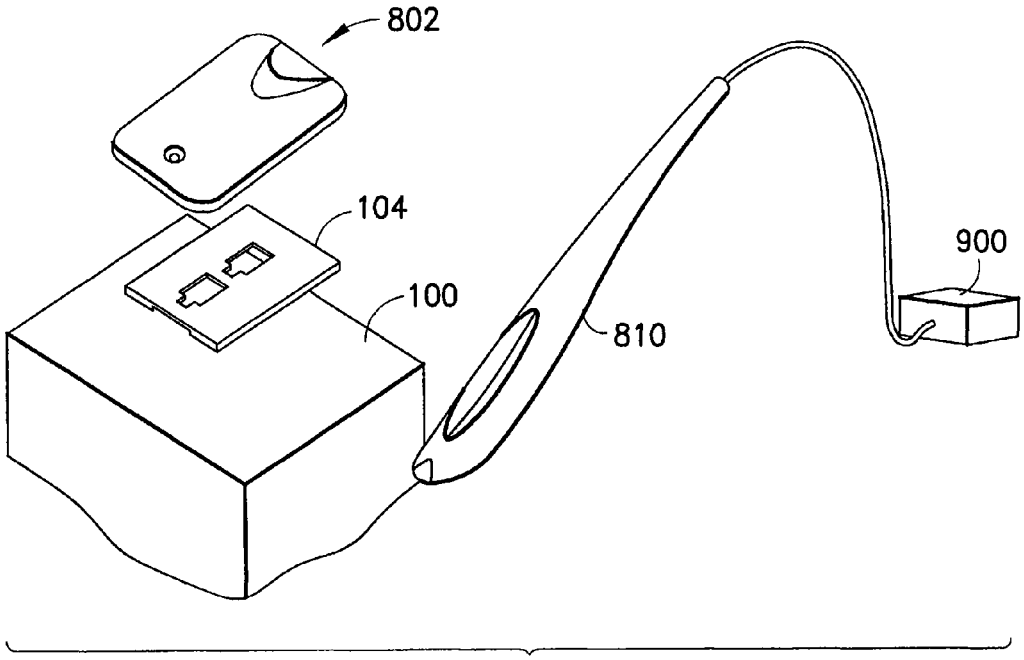
FIG. 9 is an illustration of a housing portion, membrane portion, removal wand and base station in accordance with another embodiment of the invention.

FIG. 9 illustrates the positioning of the hard tag 802 including the base membrane 104 and the removal pen, or wand, 810 relative to the merchandise 100, which, in this case, is housed in a simple carton. In addition, a base station 900 is illustrated to which the removal pen 810 is preferably attached. The base station 900 may provide power to the removal pen and may prevent operation of the removal pen if it is removed. The base station may be used to provide the deactivation signal or activation signal to the pen 810, for example.

A security tag in accordance with the present application, including tags 102 and 802, for example, preferably is operable in different modes. In a preferred embodiment, the tag 102, for example, may operate in different modes and the LED may be used to specify the mode of the tag 102. Preferably there are three general states of operation, OFF, ARMED and ACTIVE. When the tag is OFF, the tag 102 is not connected to anything and consumes no power. The tag 102 is preferably in the OFF mode before it is attached to merchandise and after it has been deactivated by pen 810, for example.

When ARMED, the tag is attached to merchandise, such as merchandise 100, for example, and is sensitive to physical tampering. That is the electrical circuit has been established between the housing 300 and the membrane 104, for example, and any disruption of that circuit will result in an alarm signal. In this mode, the LED preferably blinks in a green color in a so called "heartbeat mode." While in this mode some power is consumed, the amount of power is relatively low.

ACTIVE mode includes two sub-modes: Active P and Active E. The Active E sub-mode includes two additional sub-modes, Active EW and Active EB. In Active P (Physical) mode, the tag has been tampered with and an alarm signal is emitted, either audible or wireless which is received by any reader, such as network reader 612, for example. In this case, the LED preferably changes to red for a predetermined period of time, for example two minutes or until deactivated, by pen 810 for example. Similarly the audible alert may be emitted for a predetermined period of time or until deactivated by pen 810 for example. In Active EW, the tag is activated in a warning area discussed below with regard to warning reader 2004. The LED preferably flashes red in this mode. In Active EB mode, the tag is activated in a breach area discussed below with regard to the breach reader 2006. The LED preferably flashes red in a different pattern in this mode.

In addition, there may be a LOW BATTERY MODE where the battery such as battery 302 discussed above is wearing down. The controller, mentioned above may monitor battery life. In this mode the LED will flash amber. In addition a modified audible alarm signal may provide a warning that the battery power is low.

Figure 10:
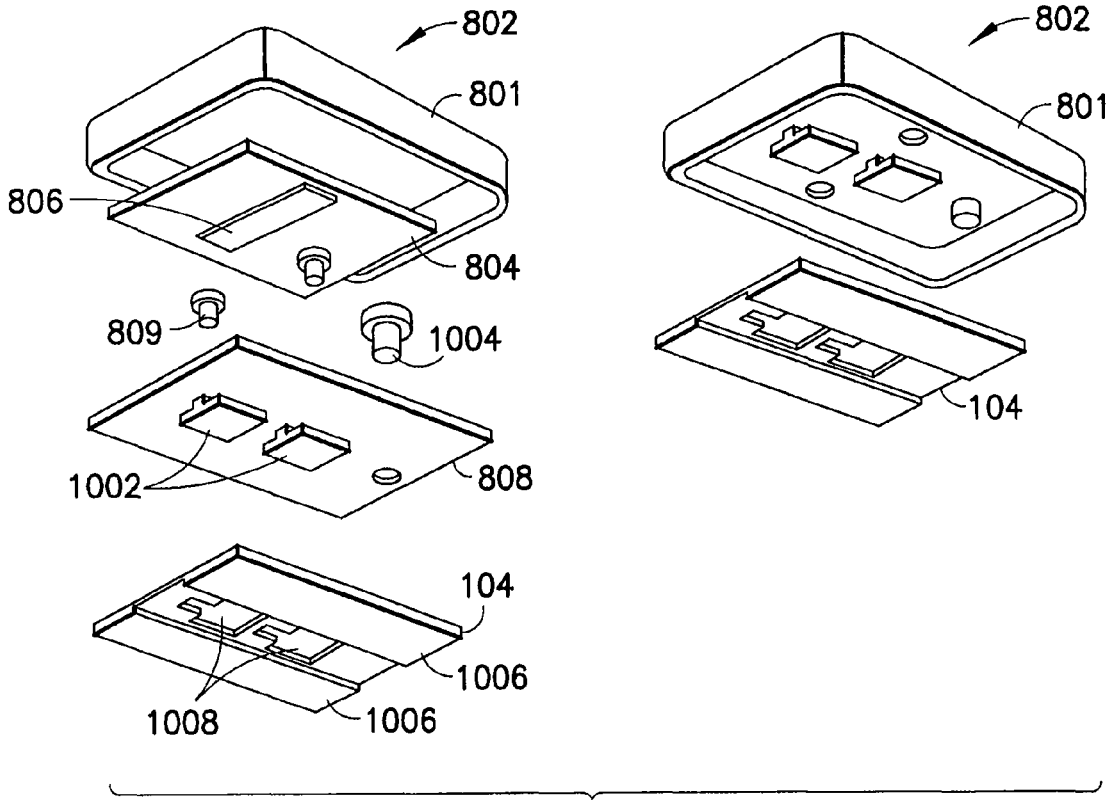
FIG. 10 is a detailed illustration of a security tag in accordance with another embodiment of the invention.

FIG. 10 provides a further illustration of how the tag 802 may be fastened to the base membrane 104. Housing 801 includes the printed circuit board 804 with contact strip 806. The inner cover 808 includes one or more protrusions 1002 that extend downward and have an I-beam shape. In addition, an opening is provided for the locking pin 1004 to extend downward through the inner cover 808. The membrane 104 may include parallel protrusions 1006 on the bottom side thereof that will contact the merchandise 100 when attached thereto. As a result, a central part of the membrane 104 has space below it between the membrane 104 and the merchandise 100 when attached thereto. Two locking slots 1008 are formed in this central part of the membrane. The protrusions 1002 of the tag 802 extend into these locking slots to secure the housing 801 to the membrane 104.

FIGS. 11 A-D illustrate longitudinal cross sections of the tag 802 and are useful in further describing how the housing 801 is attached to the base membrane 104. As illustrated in FIG. 11A, when activated, the housing 801 is securely fastened to the base membrane 104 via the protrusions 1002 on the inner cover and their engagement with locking slots 1008 in the base membrane. The locking pin 1004 prevents lateral movement of the housing 801 relative to the membrane 104.

Figure 11A:
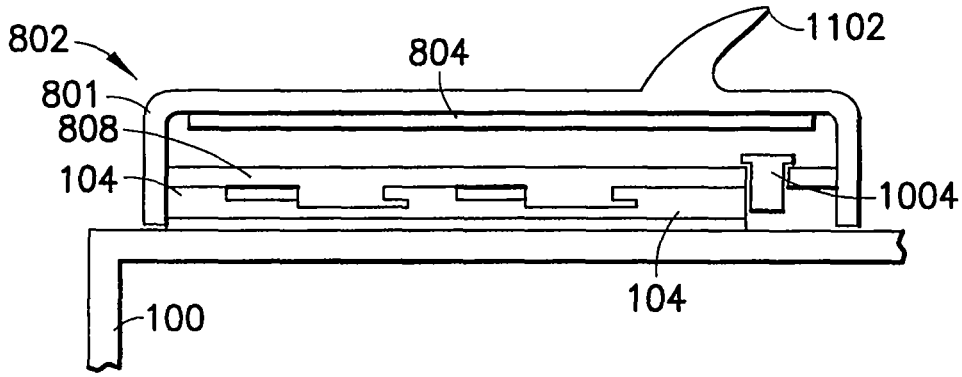
FIGS. 11A-11D illustrate cross sectional views of a security tag in accordance with an embodiment of the invention.
Figure 11B:
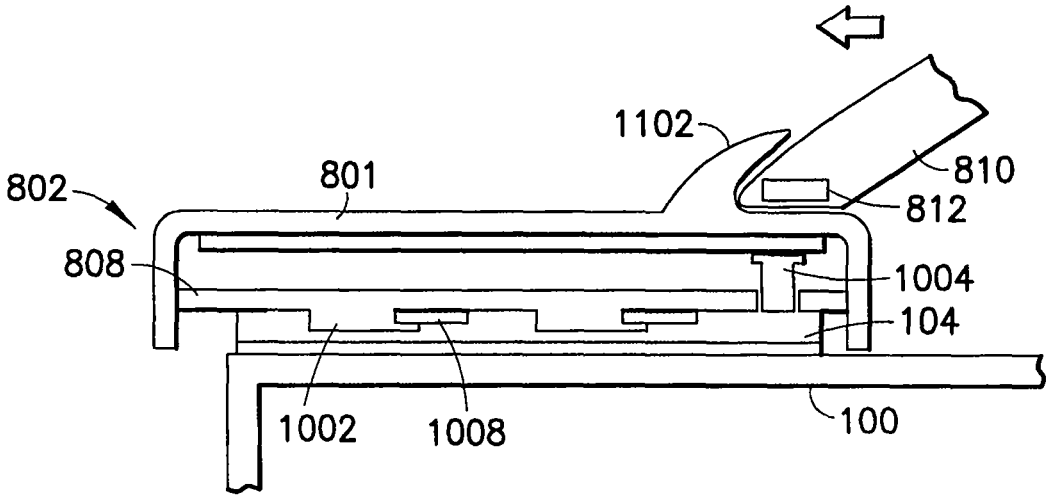
Figure 11C:
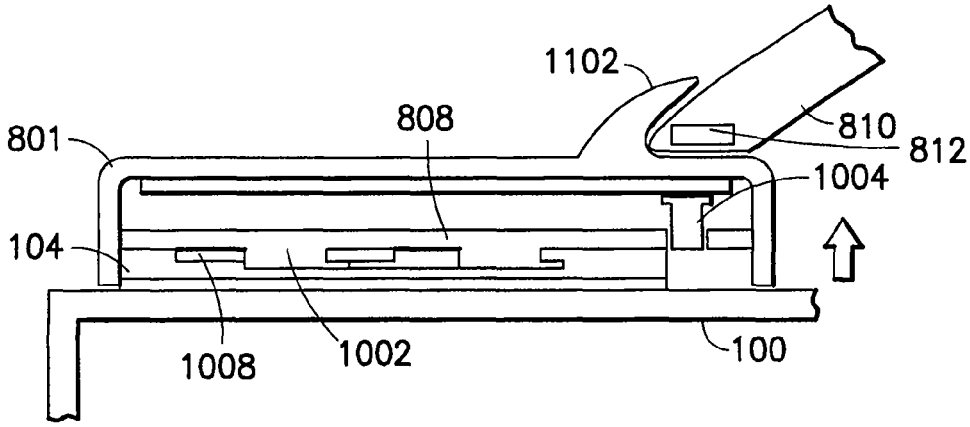
Figure 11D:
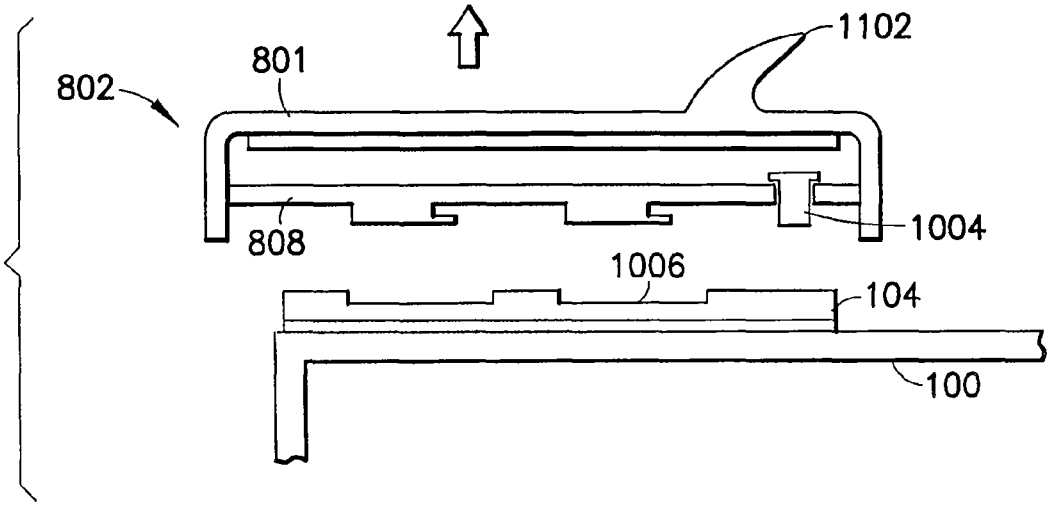

In FIG. 11B, the removal pen or wand 810 is positioned over the locking pin 1004. In this position, the magnet 812, for example, in the pen 810 lifts the locking pin 1004, thus allowing for free lateral movement of the housing 801 relative to the base membrane 104. Further, wand protrusion 1102 extending upward from the top surface of the housing 801 indicates the proper positioning of the pen 810 and provides a surface to which lateral force may be applied to the housing 801 in order to move the housing 801 laterally with respect to base membrane 104. As result of this lateral movement, the protrusions 1002 are disengaged from the locking slots 1008 in the base membrane and the housing 801 may be removed from the base membrane 104 as shown in FIGS. 11C-11D.

Thus, in accordance with the present invention, the housing may be connected to the membrane such that the connection between the two completes a circuit. Disrupting the circuit triggers the alarm to emit the alarm signal. Thus the connection between the housing and the base membrane is monitored electronically to prevent tampering. Thus, the mechanical link between the housing and the membrane is monitored electronically, that is, disruption of the electric circuit formed between the housing and the base membrane is used to indicate a disruption in the mechanical connection between the housing and the membrane.

In accordance with the present invention, the security tags, such as hard tag 102, for example, provide an alarm signal, either wirelessly or audibly externally when they are tampered with. The alarm may be audible, or may be a wireless signal sent to a receiver such as reader 604 discussed above with reference to FIG. 6. However, when the tag has not been tampered with, no alarm will sound. Generally, this is true unless a customer attempts to carry an item with a tag through sensors that are conventionally positioned at an entry to the store. This is typical for conventional EAS systems as well. However, given that no alarm is provided until the customer is already at the exit to the store, store personnel have little time to react to prevent theft.

Figure 15:
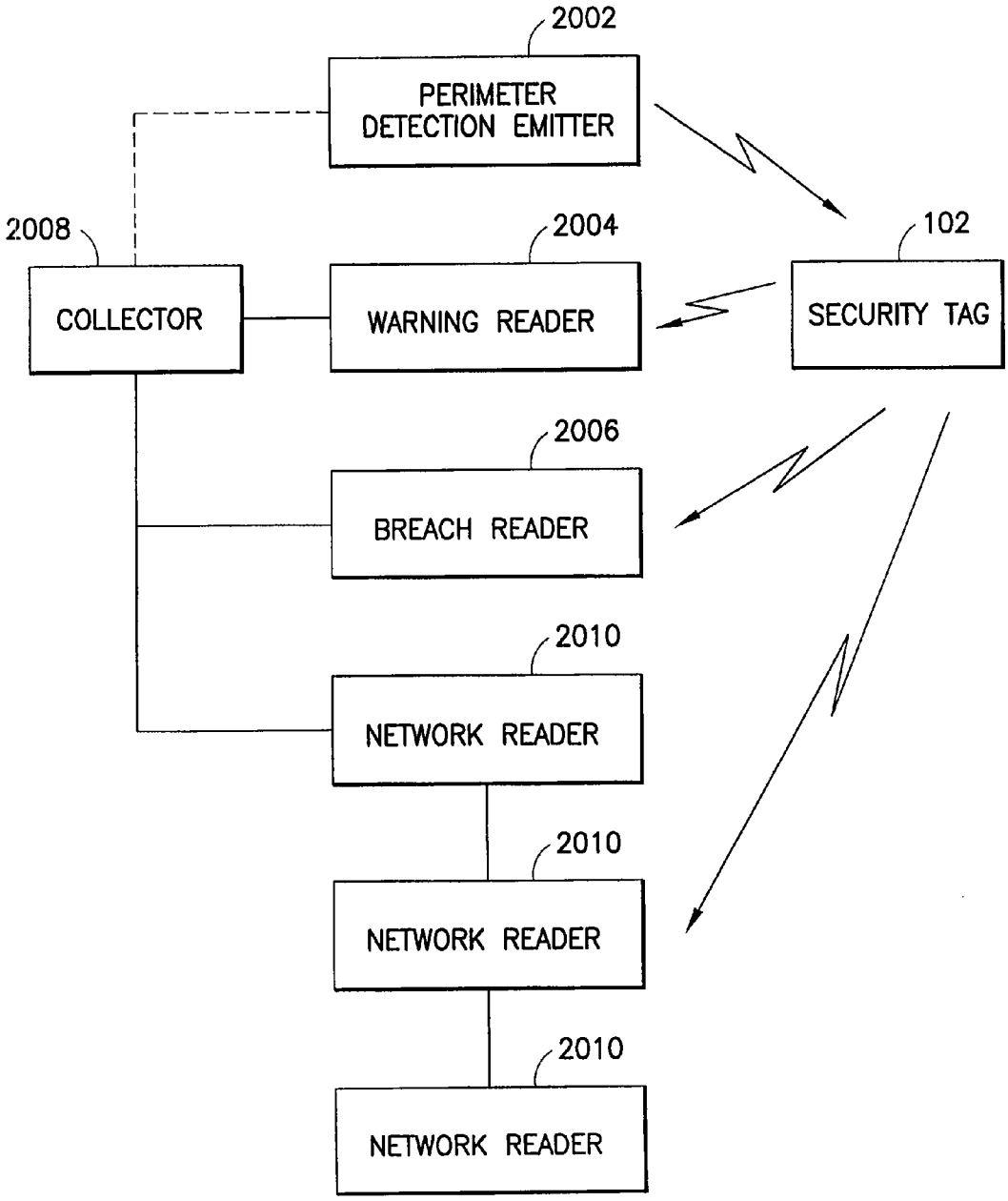
FIG. 15 is a block diagram of a security system utilizing a perimeter detection array in accordance with an embodiment of the present invention.

Thus, in accordance with another embodiment of the present invention a security system including a perimeter detection array or system (PDA) is provided to detect possible theft. That is, a security system is utilized with the security tags described above to detect and prevent security breaches. In a one embodiment, the perimeter detection array is operable to function with the security tags described above. The PDA is illustrated for example in FIG. 15. A perimeter detection emitter 2002 may be provided along with a warning (receiver) 2004, a breach reader (receiver) 2006 and a collector 2008. Additional network readers 2010 similar to the network readers 612 described above may also be included and connected to the collector 2008 as well.

Figure 16:
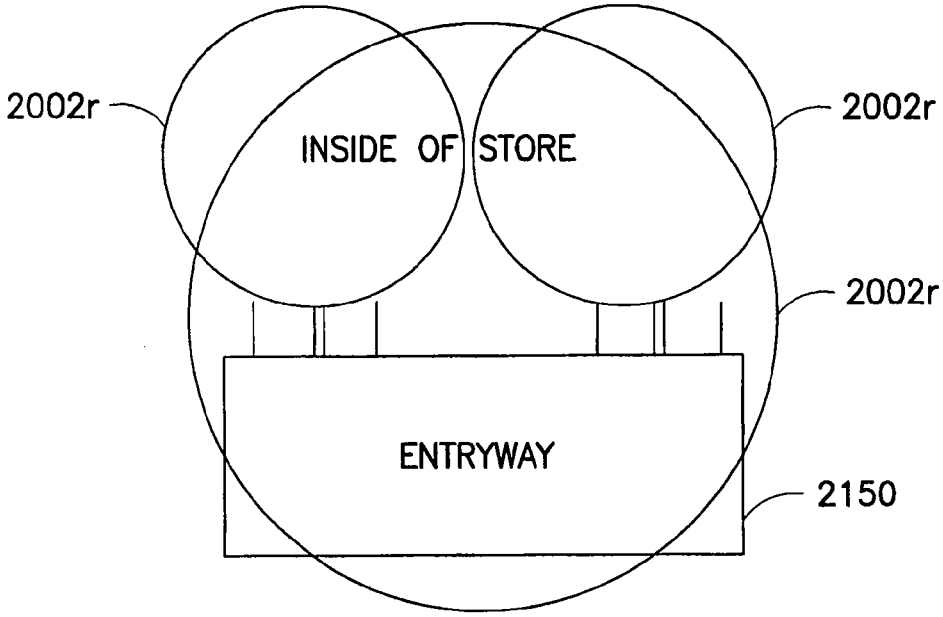
FIG. 16 is an illustration of the coverage area of a perimeter detection emitter of a perimeter detector array in accordance with an embodiment of the present invention.

The perimeter detection emitter 2002 emits a signal at a specific frequency which will activate a hard tag, such as security tag 102 to emit the alarm signal, preferably a wireless alarm signal. The perimeter detection emitter 2002 preferably has a limited range 2002*r* such that the signal emitted by the perimeter detection emitter is limited in area. Preferably, this area includes an area near an entry to the store, and a short distance outside the store. FIG. 16 illustrates one non-limiting example of such a coverage area 2002*r* of the perimeter detection emitter 2002. The circles in FIG. 16 represent the range of the emitter 2002. As can be seen in FIG. 16 there may be more than one perimeter detection emitter 2002 in an area and the position of these multiple perimeter detection emitters may be selected in order to optimize the desired coverage area of the emitters. For example, in FIG. 16, three perimeter detection emitters are provided and they are located at the center of each circle illustrated in FIG. 16.

Alternatively, it may be desired to set up additional "perimeter" areas within the store. For example, a perimeter emitter device such as emitter 2002 may be set up at, or near, a dressing room or bathroom to trigger the alarm signal in security tags on merchandise being brought to this area. While bringing merchandise to the dressing room is likely not an indication of imminent theft, it may be useful to be able to locate and track merchandise in or near the dressing room to ensure that no theft takes place. It may similarly be useful to provide a perimeter detection emitter such as emitter 2002, at or near service entrances, exits or loading docks in order to help eliminate employee theft. Similarly, while bringing merchandise into the bathroom is not necessarily an indication that theft is about to take place, it is wise to monitor the merchandise in this area.

Figure 17:
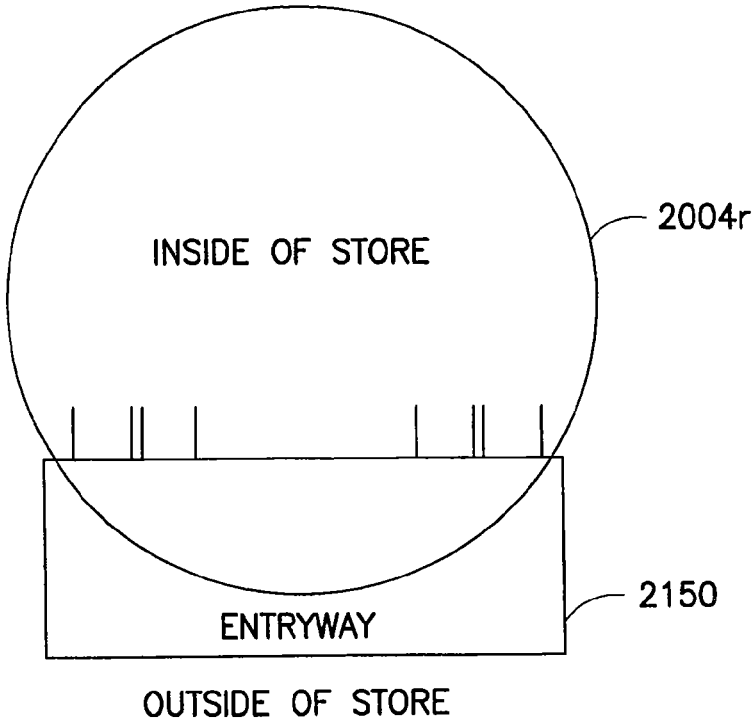
FIG. 17 is an illustration of the coverage area of a warning receiver of a perimeter detector array in accordance with an embodiment of the present invention.

The warning reader 2004 receives a signal from an activated tag in the coverage area 2004*r* (see FIG. 17) of the warning receiver. The coverage area 2004*r* of the warning reader 2004 defines the so-called warning area 2004*r*. The circle in FIG. 17 illustrates an example of such a warning area 2004*r*. The warning reader 2004 is preferably similar to the reader 604 discussed above with respect to FIG. 6. As specifically illustrated in FIG. 17, the warning area 2004*r* is preferable substantially adjacent to but extending further into the store than the entryway 2150 to the store. Additional warning areas may be established at other locations in the store wherever perimeter emitters may be positioned. The warning reader 2004 is preferably positioned in the center of the circle 2004*r* illustrated in FIG. 17. Any signal received from an active tag in this area is received by the warning reader 2004 which then preferably provides a warning alert signal to notify the collector 2008 that it is has received an alarm signal. Thus, store personnel can be notified that merchandise with an activated tag, that is, a tag that is indicating an warning alarm is approaching the entry to the store or any other "perimeter" defined by a perimeter emitter. Since the warning alert signal from the warning receiver 2004 indicates that an activated tag is approaching a perimeter area although not yet in the perimeter area, the collector 2008 may treat a signal from this particular receiver in a different manner than signals from other readers, including for example the reader 604 and the similar network readers 612 discussed above. That is, the response to reception of an alert warning signal may be more aggressive given the relatively close proximity to the entryway 2150 of the store. Alternatively, since the reception of the alert warning signal indicates only that a tag is in a warning area, and not that is has been tampered with, there may be no need to presume that theft is imminent and simple monitoring is likely sufficient.

Figure 18:
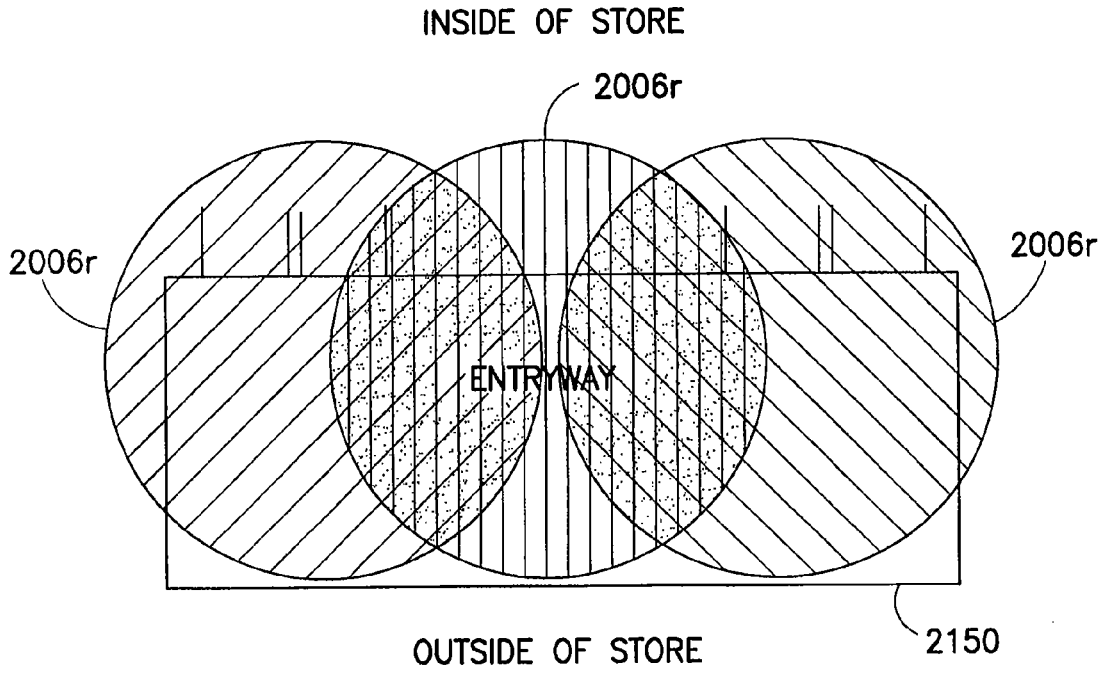
FIG. 18 is an illustration of the coverage area of a breach receiver of a perimeter detector array in accordance with an embodiment of the present invention.
Figure 23:
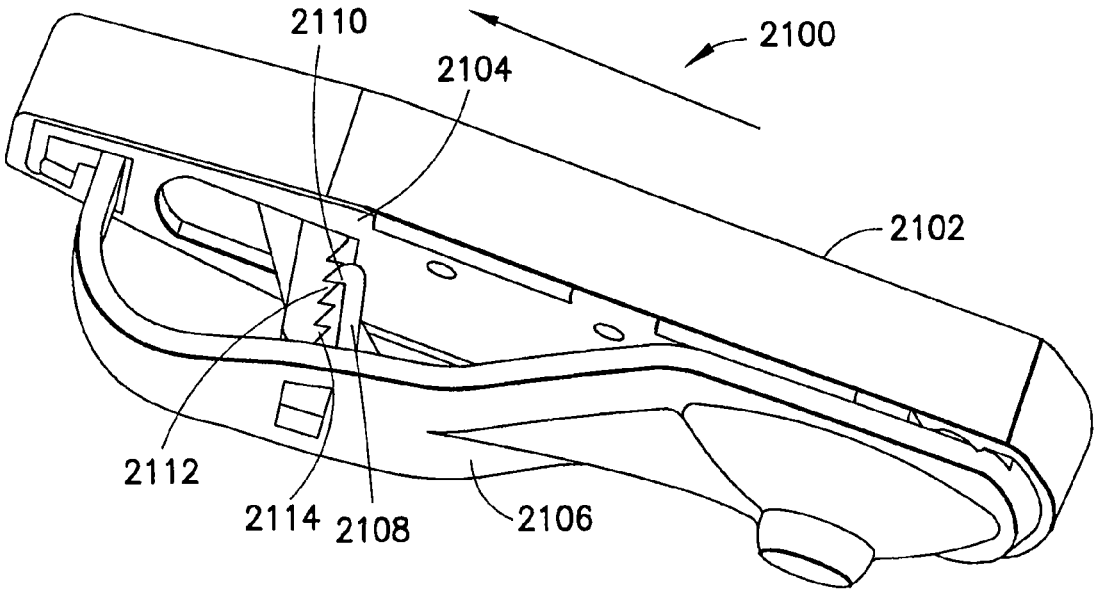
FIG. 23 illustrates a security tag for use with garments in accordance with an embodiment of the present application.
Figure 23A:
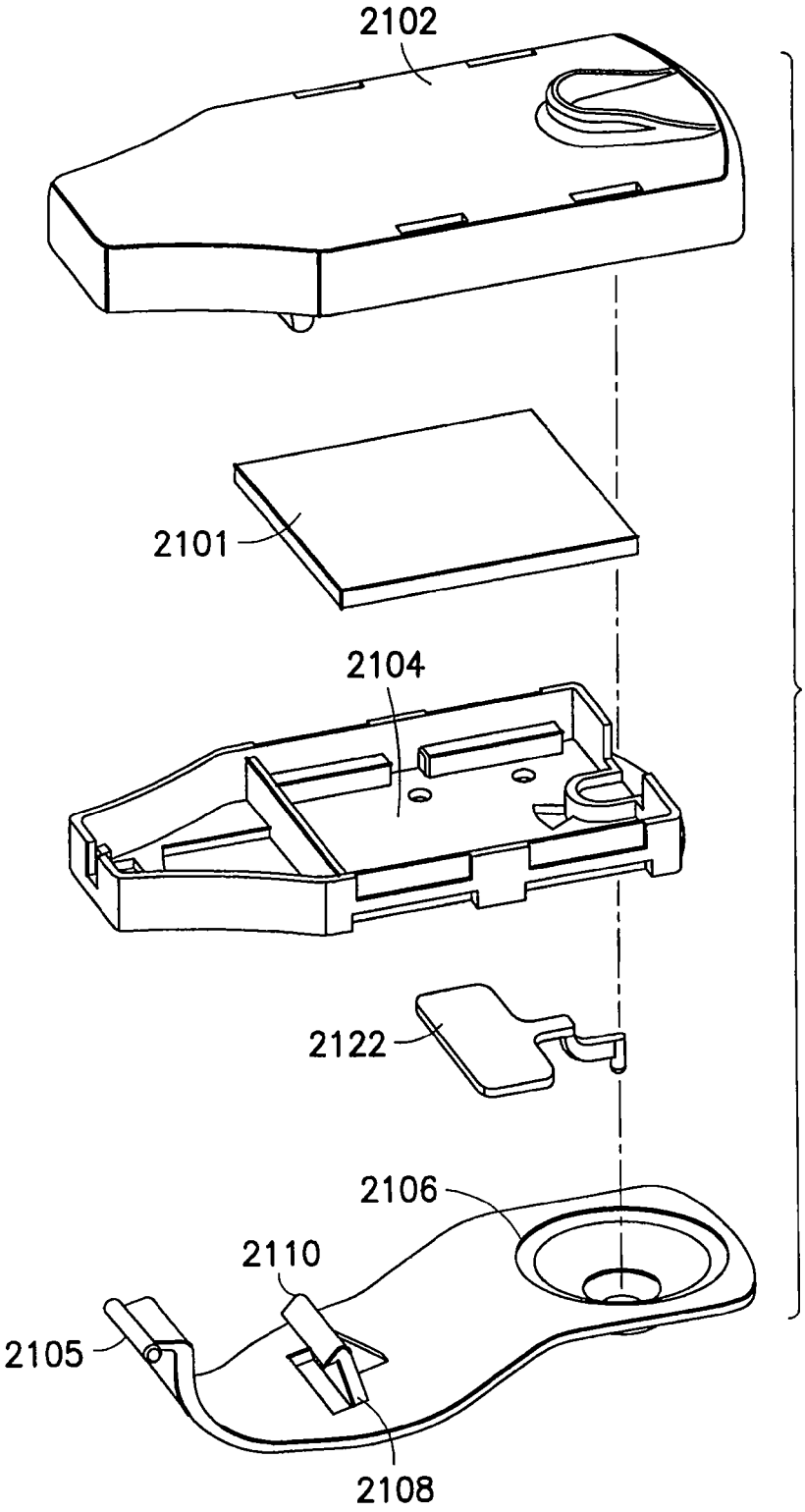
FIG. 23A illustrates an exploded view of the security tag of FIG. 23.

The breach reader 2006 is preferably positioned at the entry to the store. The breach reader 2006 also preferably has a defined area of operation 2006*r*, a so called breach area, as illustrated in FIG. 18 for example. Each of the circles in FIG. 18 represents the reception range of one breach reader 2006. As can be seen in FIG. 23, multiple breach readers 2006 with their own independent breach areas 2006*r* may be used. Preferably, the breach area 2006*r* covered by the breach reader 2006 is limited to the area immediately at the entryway 2150 to the store. Again, the breach reader 2006 is preferably similar in design to the reader 604 and the network readers 612 noted above. When any of the breach readers 2006 receive an alarm signal from an active security tag, it provides a breach alert signal to the collector 2008. Preferably, the breach reader 2006 will also trigger an audible alarm signal of the tag or at the entry to indicate that an activated security tag is at the entry to the store. The collector 2008 may process the breach alert signal from the breach receiver 2006 in a different manner as well since it indicates a possible imminent theft. Preferably, security personnel are alerted in the most expedient way possible, for example via mobile devices 608 described above with reference to FIG. 6.

Figure 19:
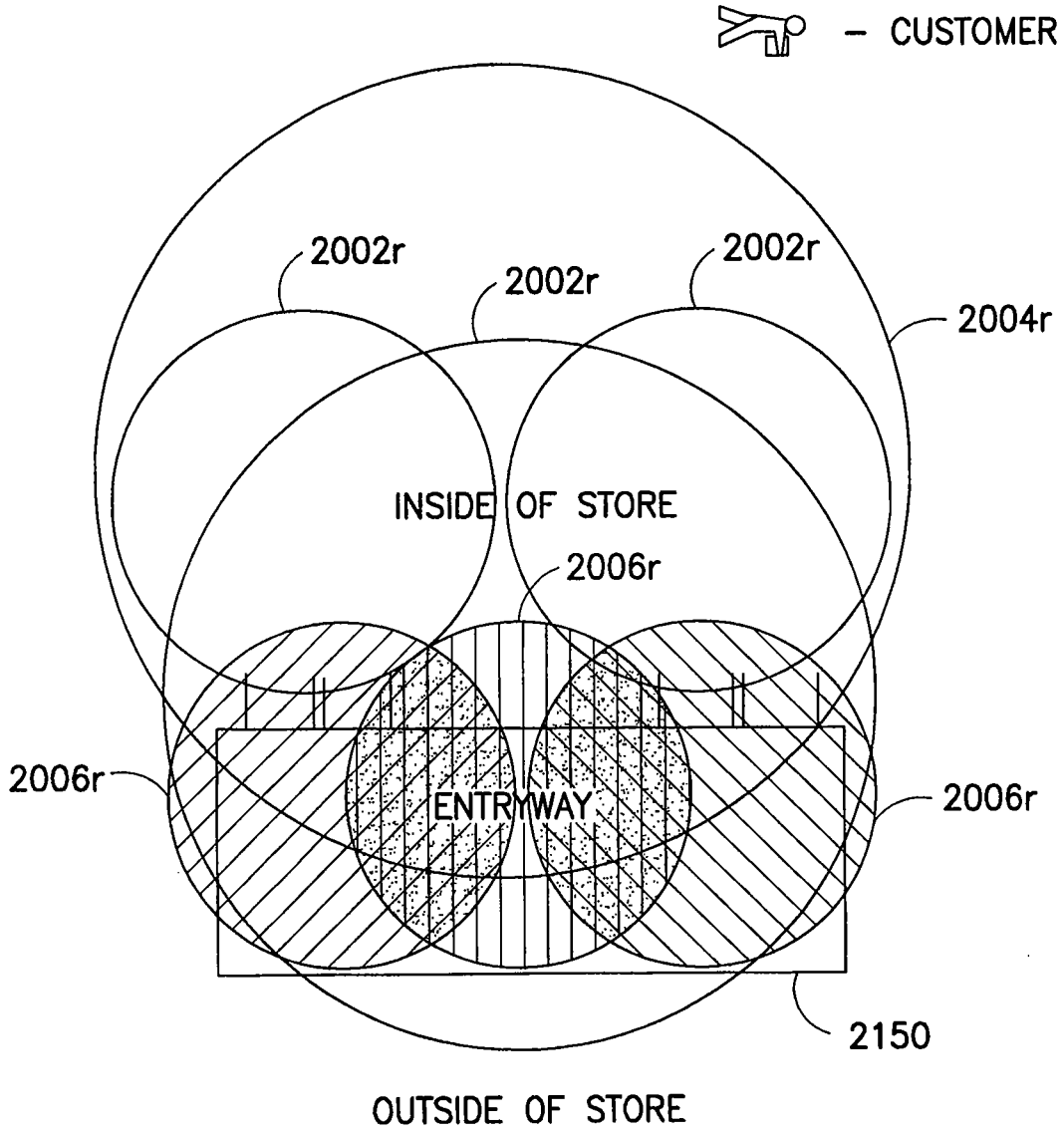
FIG. 19 illustrates the coverage areas of a perimeter detection emitter, a warning receiver and a breach receiver of a perimeter detection array in accordance with an embodiment of the present invention.

FIG. 19 illustrates the range 2004*r* of the warning reader 2004, the range 2002*r* of the perimeter detection emitter 2002, and the range 2006*r* of the breach reader 2006. As can be seen in FIG. 19, a customer with merchandise with a tag that is outside of the range 2004*r* of the warning reader 2004 is unknown to the security system or perimeter detection array (PDA). However, if the tag has been tampered with, the customer may be known to security personnel by virtue of either audible alarms, or the tamper alarm signal received by reader 604 or the network readers 612, for example.

Figure 20:
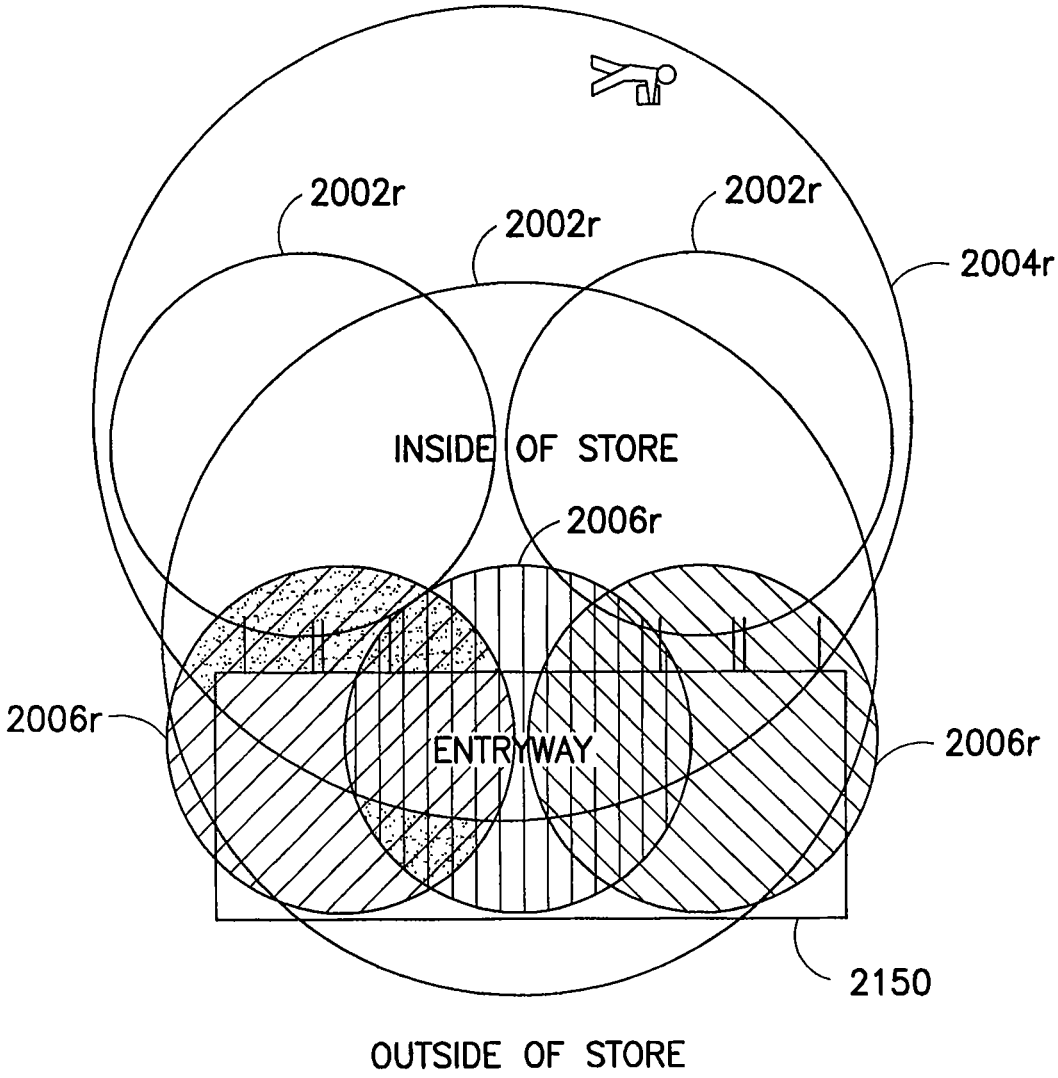
FIG. 20 also illustrates the coverage areas of a perimeter detection emitter, a warning receiver and a breach receiver of a perimeter detection array in accordance with an embodiment of the present invention.
Figure 21:
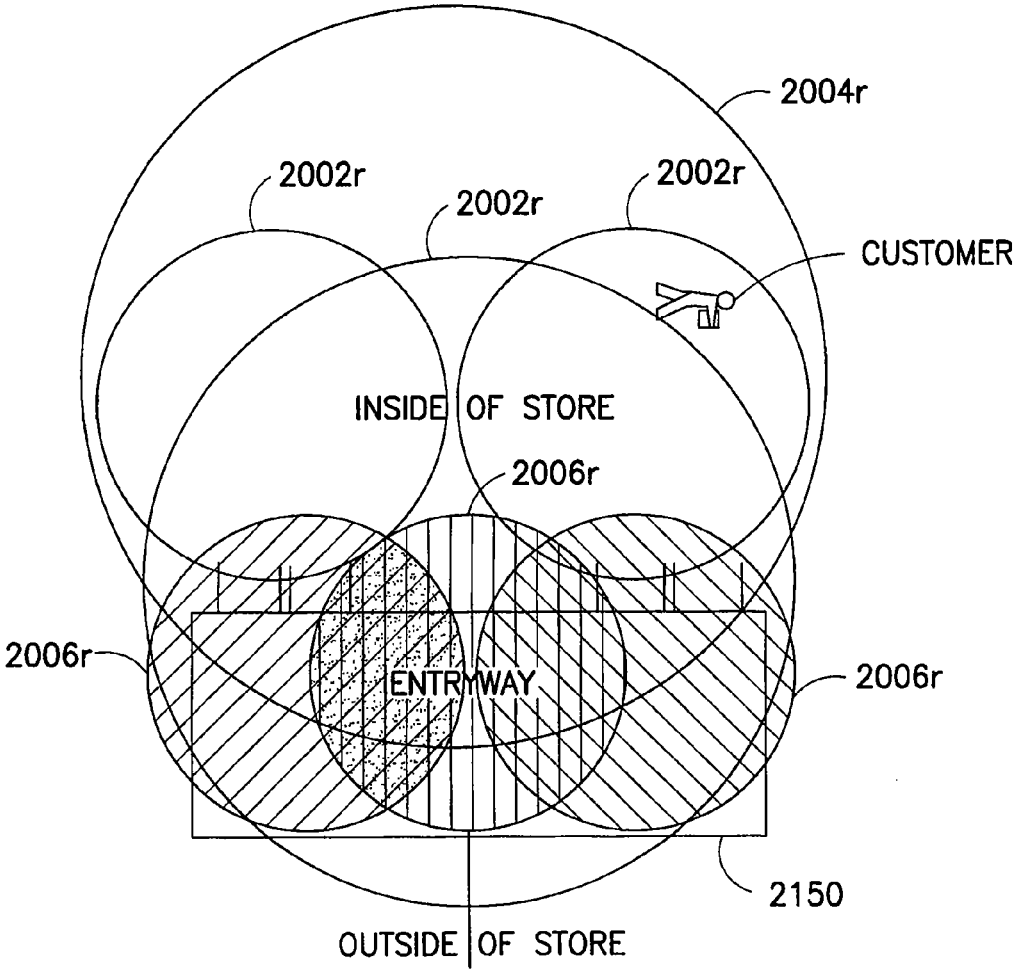
FIG. 21 illustrates the coverage areas of a perimeter detection emitter, a warning receiver and a breach receiver of a perimeter detection array in accordance with an embodiment of the present invention.

In FIG. 20, when the customer enters the warning area 2004*r*, the security system is still unaware of the customer, provided the tag has not been tampered with. That is, in this particular embodiment, the range 2004*r* of the warning receiver 2004 exceeds that of the perimeter emitter 2002. In FIG. 21, when the customer enters the range 2002*r* of the perimeter detection emitter 2002. That is, the emitter 2002 emits a signal to activate the tag to provide an alarm signal. Preferably this alarm signal is a wireless signal received by the warning reader 2004, which then sends the warning alert signal to the collector 2008. The collector 2008 will preferably notify store personnel. Further, the security tag may also emit an audible alarm as described above, however, this may not be necessary in the warning area which is still removed from the store exit. In a preferred embodiment, the security tag will continue to emit an alarm signal until and unless it is moved out of the range 2002 radius of the perimeter detection emitter 2002, thus the security system can simply monitor the merchandise closely.

Figure 22:
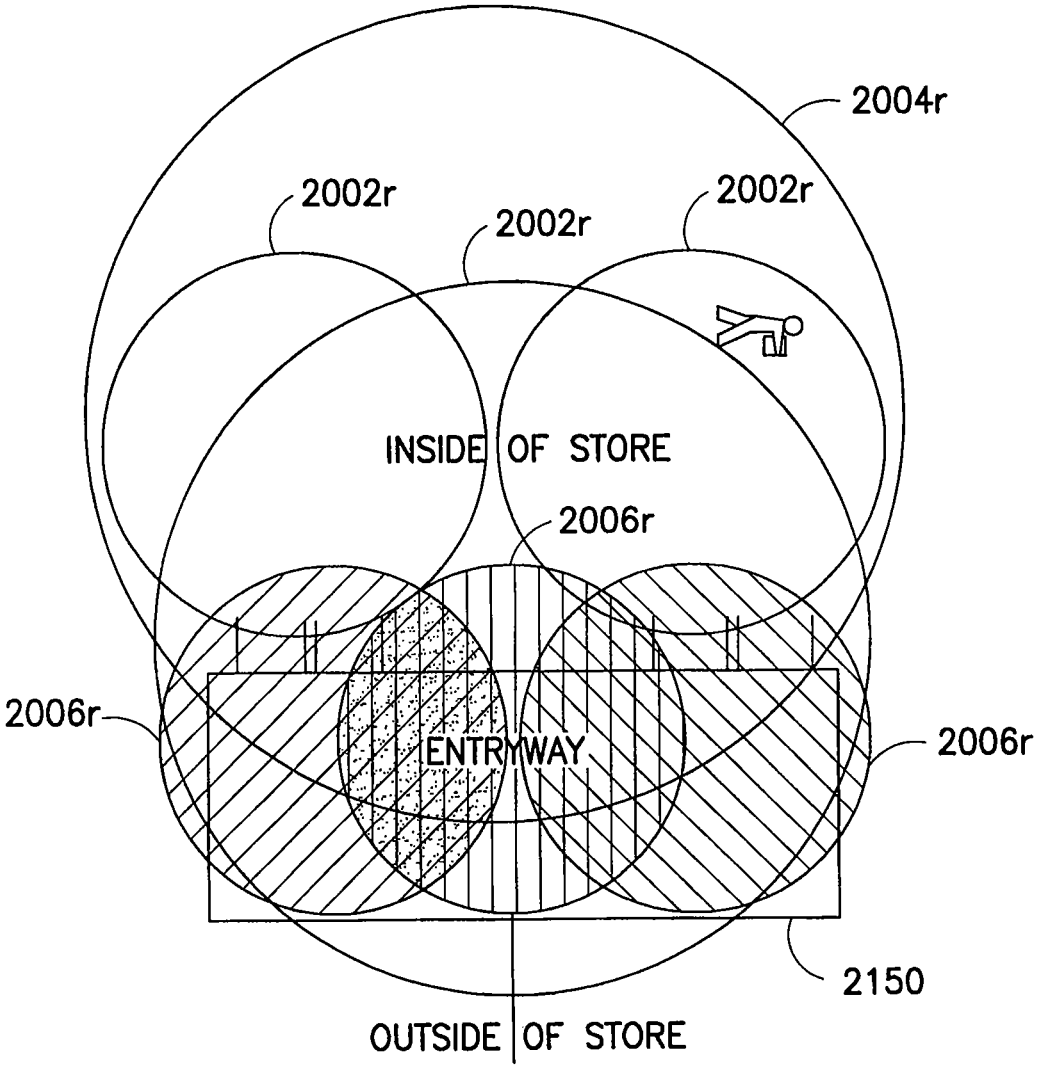
FIG. 22 also illustrates the coverage areas of a perimeter detection emitter, a warning receiver and a breach receiver of a perimeter detection array in accordance with an embodiment of the present invention.

In FIG. 22, if the customer has continued to the entryway 2150 of the store, the breach reader 2006 receives the alarm signal from the activated tag. The breach reader 2006 similarly notifies the collector 2008 via a breach alarm alert signal. In response, the collector preferably notifies store personnel. Further an audible alarm is preferably triggered in the tag itself or in sensors or a gate positioned at the entry. The alarm from the gate will preferably continue to sound until the tag is removed from the coverage area 2006*r* of the breach reader 2006.

In an alternative embodiment, the perimeter emitter 2002 may be eliminated and the warning reader 2004 and breach reader 2006 may include a warning emitter and breach emitter, respectively. That is, in this embodiment, the warning reader 2004 is a warning transceiver (transmitter/receiver) operable to both emit a warning emission signal in the warning area and to receive a warning alarm signal from a security tag in the warning area. Similarly, the breach reader may be operable to both emit a breach emission signal and receive a breach warning signal from a security tag in the breach area. In this embodiment, it is preferable that the warning emission signal and breach emission signal are separate and distinct signals that are differentiated by the security tag. For example, they may be transmitted at a common frequency, but with a different pulse rate. Similarly, the warning alarm signal and breach alarm signal provided by the tag are also separate and distinguishable signals as well. In this manner, the design of the security system may be simplified such that the warning reader/emitter and breach reader/emitter have substantially the same design and construction while still providing distinct signals.

Naturally, a separate warning emitter (not shown) may be provided in the warning area with the same range as the warning reader 2004 and emit the warning emission signal at a specific frequency to trigger the warning alarm signal in the security tag to be received by the warning reader. Similarly, a breach emitter (not shown) may be provided in the breach area with the same range as the breach reader 2006 and emit the breach emission signal to trigger the breach alarm signal in the tag to be received by the breach reader 2006. The warning alarm signal and breach alarm signal emitted by the tag may be referred to as zone signals as they may be used to indicate a zone or area in which a security tag is present.

In yet another alternative embodiment, the perimeter emitter 2002 may emit both the warning emission signal and the breach emission signal such that the warning emission signal and the breach emission signal have different ranges and thus designate a separate warning area 2004*r* and breach area 2006*r*, respectively. As noted above, these two emission signals are preferably distinguishable by the security tag, which emits a warning alarm signal or breach alarm signal, respectively, in response to the warning emission signal and the breach emission signal. The warning alarm signal and breach alarm signal may be received by the warning reader and breach reader as noted above, or may be received by any one of the network readers 612, for example. Thus, in accordance with this embodiment, the network readers 612 are preferably operable to distinguish the warning alarm signal from the breach alarm signal and to generate a warning alert signal or breach alert signal, as appropriate, to be sent to the collector.

The collector 2008 may be a computer system or dedicated PC or any other device that is operable to receive notification from the warning receiver and the breach receiver. The collector 2008 may include or may be connected to the intra-store communication network 606 of FIG. 6 as well. Further, the collector 2008 may be adapted to receive alert signals from any of the other readers in the store, for example the reader 604 or the network readers 612. The collector 2008 may further include or be provided access to wireless communication in order to alert store personnel about alarm signals, for example via the mobile devices 608 discuss with reference to FIG. 6. In addition, it may be useful for the collector 2008 or a computer connected thereto to include a map of the store such that the position of an activated tag in the store can be determined. Such a map may also be incorporated into the mobile devices, 608 carried by security personnel to locate an activated tag using location information included in the wireless signals sent to the mobile devices at the direction of the collector. As noted above, the position of the activated tag may be determined by the location of the reader, whether it is reader/receiver 604, one of the network readers 612, the warning reader 2004 or the breach reader 2006 that has received the alarm signal. The collector 2008 may also control one or more security cameras, such as the cameras providing camera feed 610 in FIG. 6 to activate a camera in the location of the activated security tag. Similarly, the collector 1008 may control one or more recording devices used to record the footage of the camera feeds 610 to insert a bookmark or flag in the footage when an alarm signal is received.

In a preferred embodiment, the reception area of each reader in the store including each of the network readers 612 is finely tuned. Thus, in a preferred embodiment, the readers are positioned throughout the store and the reception range of each of the readers is clearly defined. Thus, the position of a particular security tag that is emitting an alarm signal can be largely pinpointed based solely on the specific reader that receives the alarm signal. Further, in a preferred embodiment, the range of each of the readers may be remotely changed, preferably utilizing wireless instructions that are emitted by a portable computer, for example, within the range of a particular receiver. In this manner, each receiver can be individually tuned to have the desired range and thus maximize the effectiveness of the security system.

The security system described above enhances the usefulness of the security tags described above in that it triggers the tags, even if not tampered with, when the tags are brought close to the entry of the store or any other designated "perimeter area". In this manner, store personnel have additional warning of a possible theft and have more time to react to prevent it.

The security tags described above and for use with the perimeter detection system described above may take the form of several different embodiments. The tag 102, for example, can be simply attached to a box or carton and may be easily attached to certain specific products. However, in accordance with the present invention, the security tags may be used in conjunction with a wide variety of merchandise.

Figure 12A:
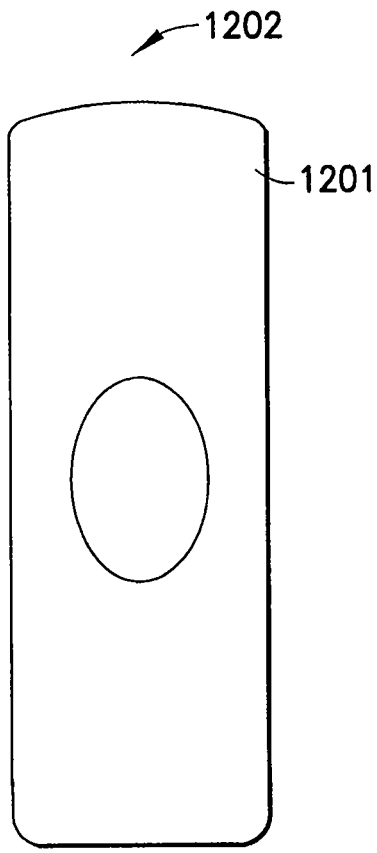
FIG. 12A illustrates a top view of a security tag in accordance with another embodiment of the invention.
Figure 12B:
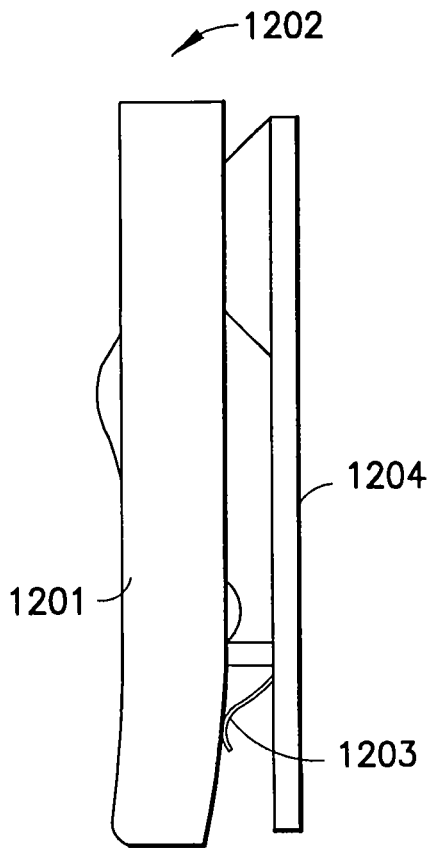
FIG. 12B illustrates a side view of the security tag of FIG. 12 A.

FIGS. 12A-B illustrate a specific embodiment of a hard tag 1202 for use with merchandise such as clothing or other garments. The hard tag 1202 includes a housing or cover 1201 which is pivotally attached to a base 1204. A spring member 1203 on the base 1204 biases the housing 1201 in the closed position as illustrated in FIG. 12.

The hard tag 1202 of FIGS. 12A-B is described in further detail with regard to FIGS. 13 A-D and 14A-D. The housing 1201 houses a locking pin 1302, an alarm pin 1304, a printed circuit board (PCB) 1306 and a hinge top 1308. An axle 1310 is provided about which the housing 1201, more specifically hinge top 1308, pivots with respect to the base 1204. A protrusion 1312 is provided on the top surface of the base 1204 with a hole for the axle 1310 to provide a place at which the hinge top 1308 is pivotally attached to the base 1204.

FIGS. 14A-D illustrate how the hard tag 1202 interacts with a removal pen or wand 1402 to release the hard tag. The removal pen 1402 may be substantially similar to the optical removal wand 502 or the removal pen 810 described above. The locking pin 1302 is biased downward by a spring and through an opening in the hinge top 1308 to prevent lateral movement of the housing 1201 relative to the hinge top 1308. A protrusion 1401 of the hinge top 1308 engages teeth 1404 of the protrusion 1312 of the base 1204 to prevent pivoting of the hinge top relative to the base.

Figure 14A:
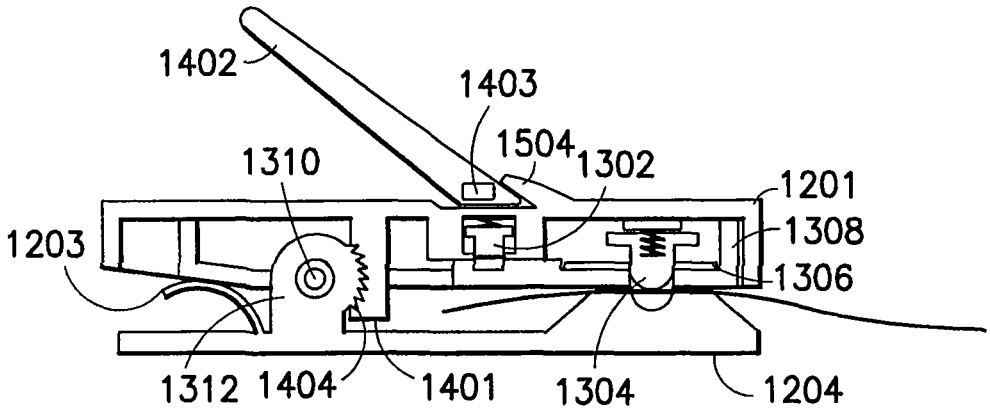
FIGS. 14 A-D illustrate the security tag of FIGS. 12A-B being released from a garment.

As shown in FIG. 14A, the removal pen 1402 preferably includes a magnet 1403 which lifts locking pin 1302 out of the opening in the hinge top 1308. As a result, the housing 1201 is freed to slide laterally with regard to the hinge top 1308. As illustrated in FIG. 14A, for example, the housing 1201 may include a protrusion 1504 to mark the location of the locking pin and to provide a surface against which lateral force may be applied to the housing 1201 to move it relative to the hinge top 1308. As a result, the protrusion 1401 is moved away from the teeth 1404 (see FIG. 14B) and the hinge top 1308 is free to pivot as illustrated by the arrow in FIG. 14 C. Since the spring member 1203 is provided, a user must apply some force downward to counter this bias in order to pivot hinge top 1308.

Figure 13A:
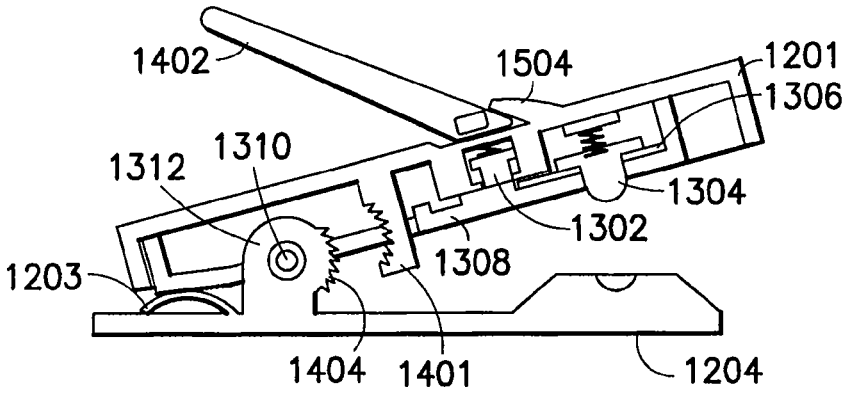
FIGS. 13A-D illustrate the security tag of FIGS. 12A-12B being attached to a garment.
Figure 13B:
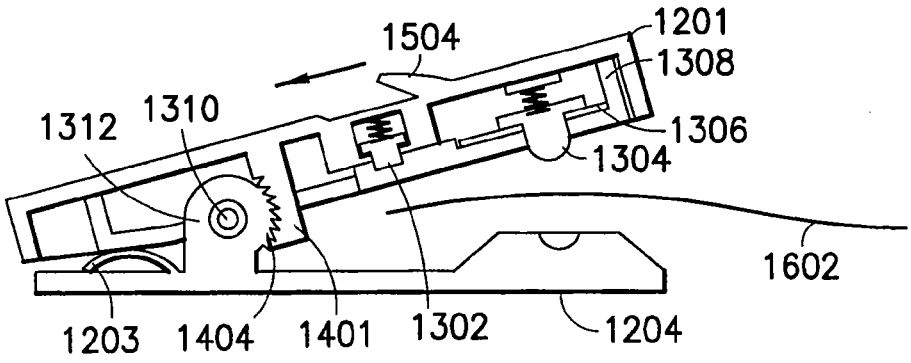
Figure 13C:
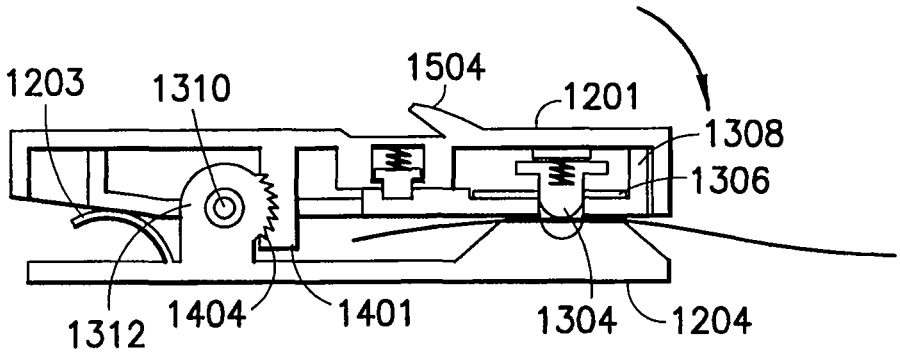

As seen in FIG. 13B, once opened, the housing 1201 may be slid laterally in the opposite direction such that the teeth 1404 approach the protrusion 1401. As illustrated in FIG. 13-C, a piece of clothing 1602 is preferably positioned between the alarm pin 1304 and the base 1204 while in the open position. The housing 1201 is preferably then closed as shown in FIG. 13C, positioning the garment between the alarm pin 1304 and the base 1204. In the closed position, as noted above, the locking pin enters the opening in the bottom hinge to prevent lateral sliding of the housing 1201 relative to the hinge top. Further the teeth 1404 engage the protrusion 1401 to prevent the hinge top and housing 1201 from pivoting to the open position.

Figure 14B:
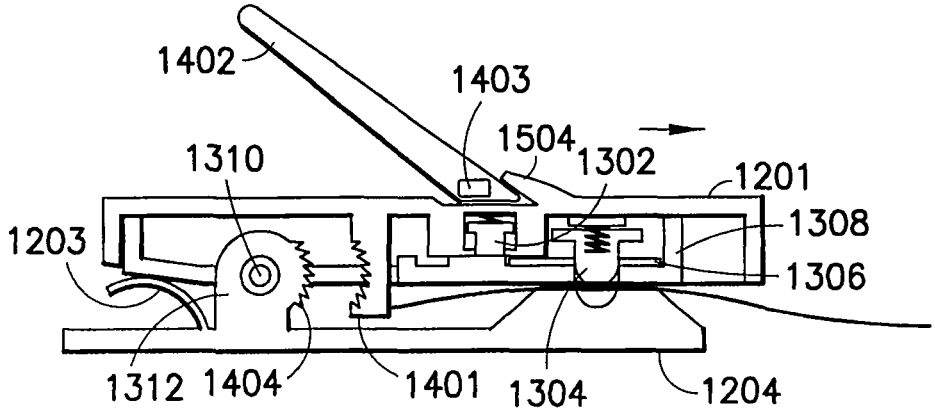
Figure 14C:
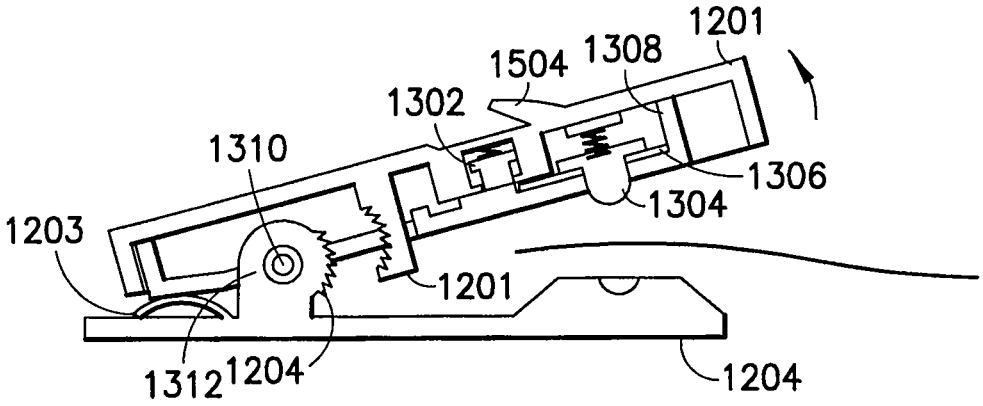
Figure 14D:
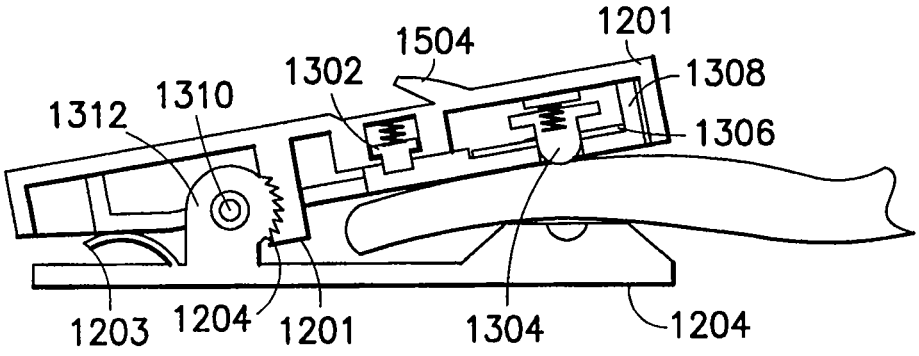

The tag 1202 can be opened so that it can be removed from the garment 1602 in a manner similar to that described above. That is, the removal wand or pen, such as pen 810, for example, lifts the locking peg to allow the housing 1201 to move forward with respect to the base 1204 releasing the protrusion 1401 from the teeth 1404. FIGS. 14A-C substantially illustrate this process.

Figure 13D:
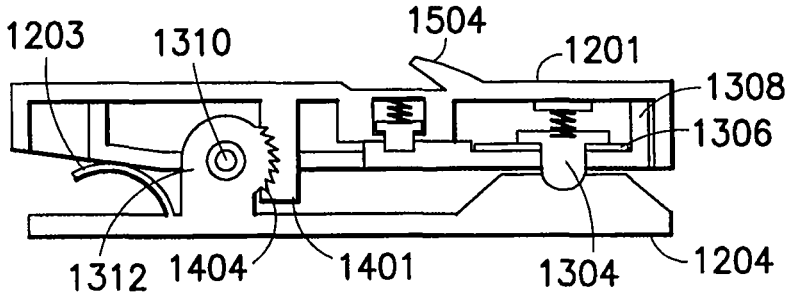

As illustrated in FIG. 13D, once in the closed position, where the garment is removed from its position between the housing 1201 and the base 1204 an alarm sounds. More particularly, alarm pin 1304 drops to contact the base 1204 and the flange formed in the top of the alarm pin contacts the printed circuit board (PCB) to activate the alarm. As can be seen with reference to FIG. 14D, the tag is capable of accommodating relatively thick garments without difficulty.

Thus, in the security tag 1202 illustrated in FIGS. 13-14 and described above, the mechanical attachment of the garment to the tag is monitored by an electric circuit. The alarm pin 1304 is in physical contact with the garment. If the garment is removed, the alarm pin drops into contact with the PCB, thus completing the circuit and triggering emission of an alarm signal. Therefore, the mechanical connection of the tag to the merchandise is monitored electrically. This is similar to the way that the electrical circuit formed between the housing 300 for example and the base membrane 104 monitored the status of the mechanical connection between the housing and base membrane.

Figure 24:
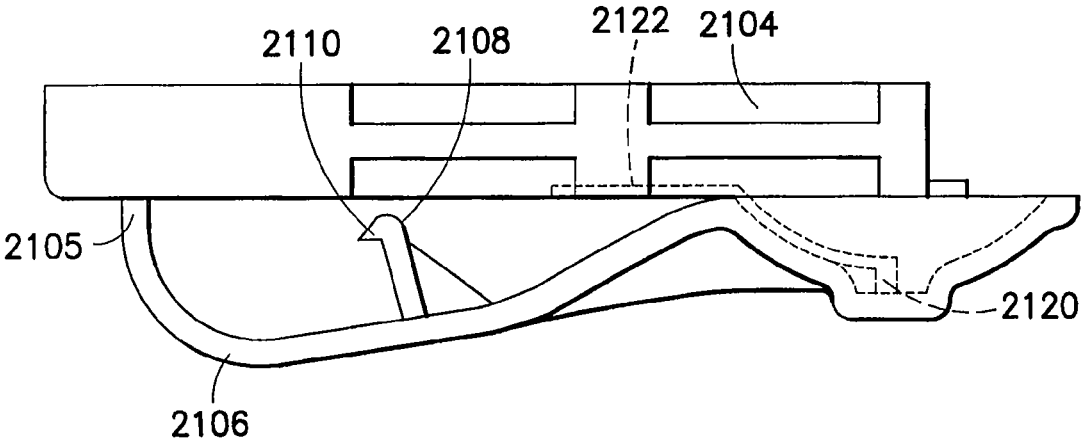
FIG. 24 illustrates a more detailed view of the security tag of FIG. 23.

FIGS. 23-24 illustrate another embodiment of a security tag 2100 for use with garments in accordance with the present application. The tag 2100 preferably includes a top shell 2102, a sliding plate 2104 and a securing arm 2106. The sliding plate 2104 fits within the top shell 2102 such that the top shell and sliding plate 2104 are slideable in a lateral direction relative to each other. That is, the top shell is slidable in the direction of the arrow with respect to the sliding plate 2104. In addition, the sliding plate 2104 preferably supports a printed circuit board (PCB) 2101 similar to the circuit boards 308, 804 discussed above. The securing arm 2106 is pivotally connected to the sliding plate 2104 at pivot point 2105. The securing arm 2106 includes an upwardly extending lock protrusion 2108 that includes at least one downward inclined tooth 2110. This tooth 2110 interacts with a plurality of upwardly inclined teeth 2114 on a downward protrusion 2112 projecting downward from the top shell 2102 to prevent the securing arm from pivoting at pivot point 2105. In operation, a piece of fabric is positioned between the securing arm 2106 and the sliding plate 2104 when the tag 2100 is in the closed position as is illustrated in FIG. 23, for example. Since the securing arm 2106 is prevented from pivoting by the interaction of tooth 2110 and teeth 2114, the securing arm secures the fabric in place.

As illustrated in FIG. 24, the tag 2100 further includes an alarm pin 2120 that extends from a top surface of the intermediate sliding plate 2104 down though an opening therein to contact the garment. Contacts 2122, on the end of the pin 2120 connect to the circuit board 2101 discussed above to complete an electric circuit when the pin 2120 is in contact with the garment. If the garment is removed from under the pin 2120, that is, if the tag is tampered with, the pin will move down and contact between the contacts 2122 and the PCB will be broken. This open circuit preferably triggers an alarm signal in a manner similar to that described above.

Figure 24A:
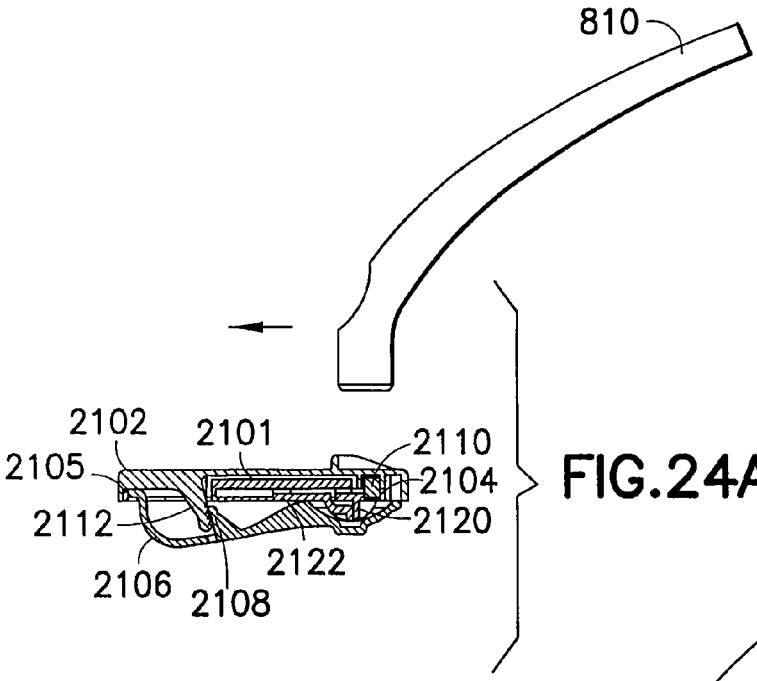
FIGS. 24A-C illustrate cross-sectional views of the security tag of FIG. 24.
Figure 24B:
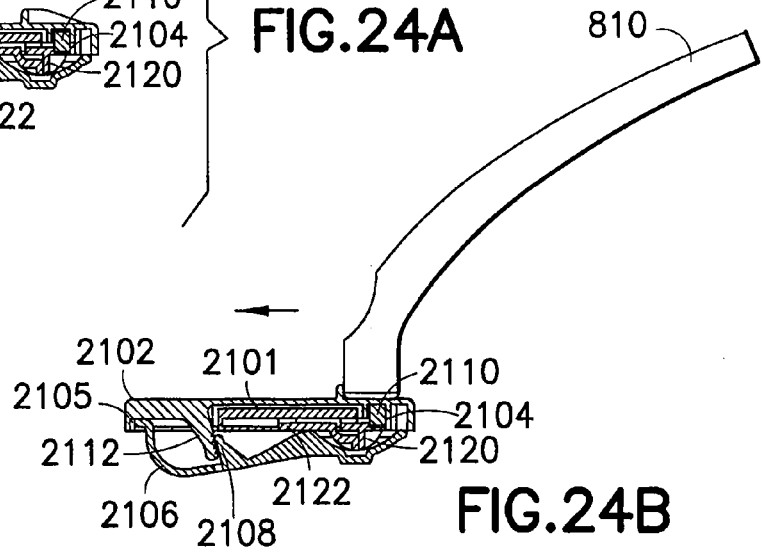
Figure 24C:
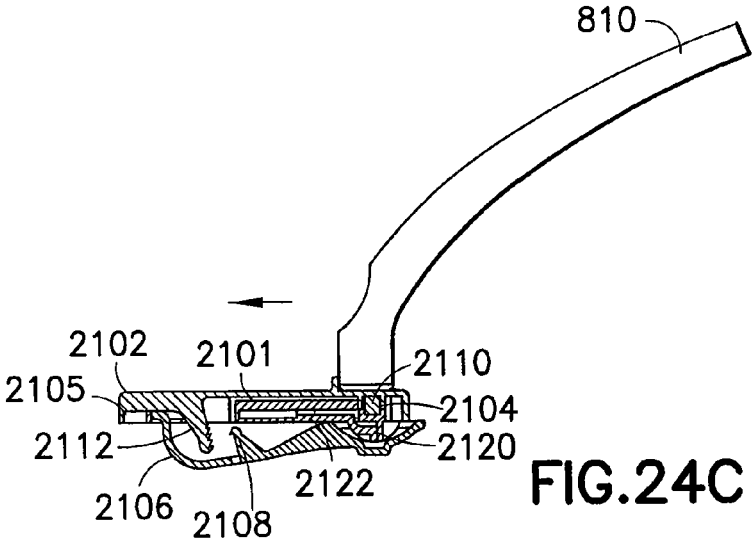

As noted above, the sliding plate 2104 may slide in the direction of the arrow in FIG. 23. However, as illustrated in FIGS. 24A-C, a lock pin 2110 is preferably position in the top shell 2102 and extends down to lock the sliding plate into place when in the locked position. The lock pin 2110 is preferably made of a magnetic material such that a magnet can be used to lift the lock pin and release the top shell 2102 to slide relative to the sliding plate 2104. Thereafter, the top shell 2102 can be slid laterally in the direction of the arrow in FIG. 23, for example to separate the tooth 2110 from the teeth 2114 and allow the securing arm 2106 to pivot into the open position to release the garment. Preferably, the alarm is deactivated prior to release and thus the alarm does not sound. The alarm may be deactivated by a wand or pen 810, for example, in a manner similar to that described above. That is the top shell 2102 preferably includes at least one electrical tag contact on a top surface thereof which contacts the electrical contacts 811 of pen 810 to receive the deactivation signal to deactivate the alarm. The pen may similarly include a magnet, such as magnet 812, for example to lift the lock pin 2110 and release the sliding plate 2104.

While not specifically illustrated, the tag 2100 described above also preferably includes a controller and an EAS tag or RFID tag as described above with reference to FIGS. 3 and 4, for example. The tag also preferably includes a transceiver similar to that described above, which may be incorporated with the RFID tag or EAS ID tag or separately provided on a circuit board, such as a printed circuit board PCB similar to that described above.

Naturally, the security tags 1202 and 2100 described above may be used in conjunction with the perimeter detection system described above as well.

Figure 25:
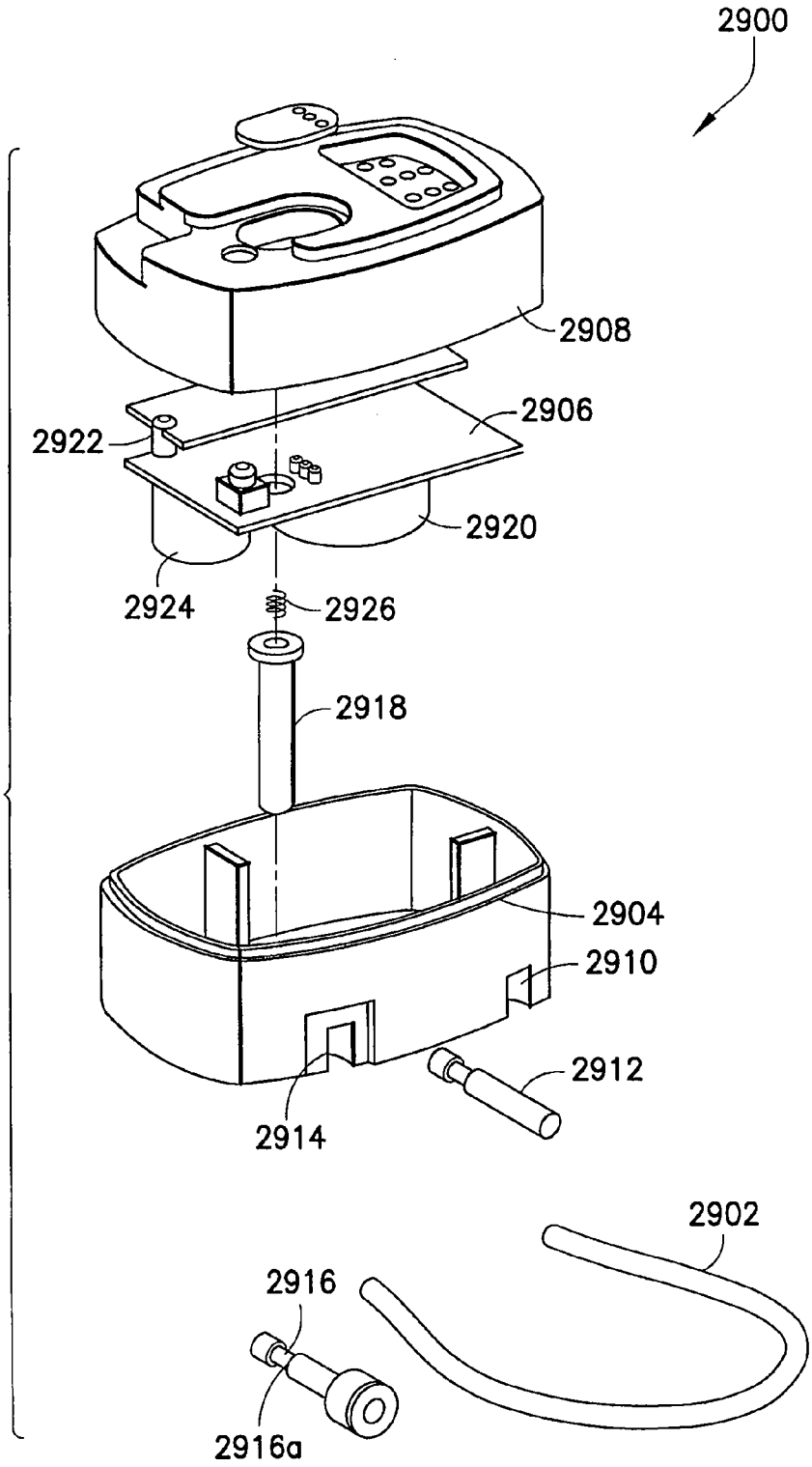
FIG. 25 illustrates a security tag in accordance with another embodiment of the present invention.

In another embodiment of the present invention, a security tag may be connected to merchandise by a lanyard or security cord. FIG. 25 illustrates an example of a security tag 2900 in accordance with the present invention that is attached to merchandise via a lanyard or security cord 2902. As illustrated in FIG. 25, the security tag 2900 includes a housing 2904 in which a circuit board such as printed circuit board (PCB) 2906 is positioned. A cover 2908 connects to the housing to cover the printed circuit board. The printed circuit board may have a battery 2920 and an LED 2922 attached thereto in a manner similar to that described above with reference to FIGS. 3-4, for example. The housing 2904 includes a first slot 2910 into which an anchor 2912 is preferably fixedly mounted. The anchor 2912 is connected to one end of the connecting portion 2902, which is operable to connect the housing and cover to merchandise to be secured. A second slot 2914 is formed in the housing to detachably receive plunger 2916, which is connected to the other end of the connecting portion 2902. The plunger 2916 includes a locking notch **2916*a* which contacts a locking pin 2918 in the housing when the locking pin is in the locked positioned to prevent the plunger 2916 from being removed from the housing. A spring 2926 may be used to bias the locking pin downward into the locked position. The connecting portion may be embodied as a cord as illustrated and is preferably made of an electrically conducting material. Similarly, the anchor 2912 and the plunger 2916 are also made of an electrically conducting material and preferably contact the PCB 2906 to complete a circuit. If the circuit formed by the anchor 2912, connecting portion 2902, and plunger 2916 is disrupted, an alarm 2924** included on the PCB, for example, preferably emits an alarm signal in a manner similar to that described above. The alarm signal may be audible and/or may be a wireless signal.

Figure 26A:
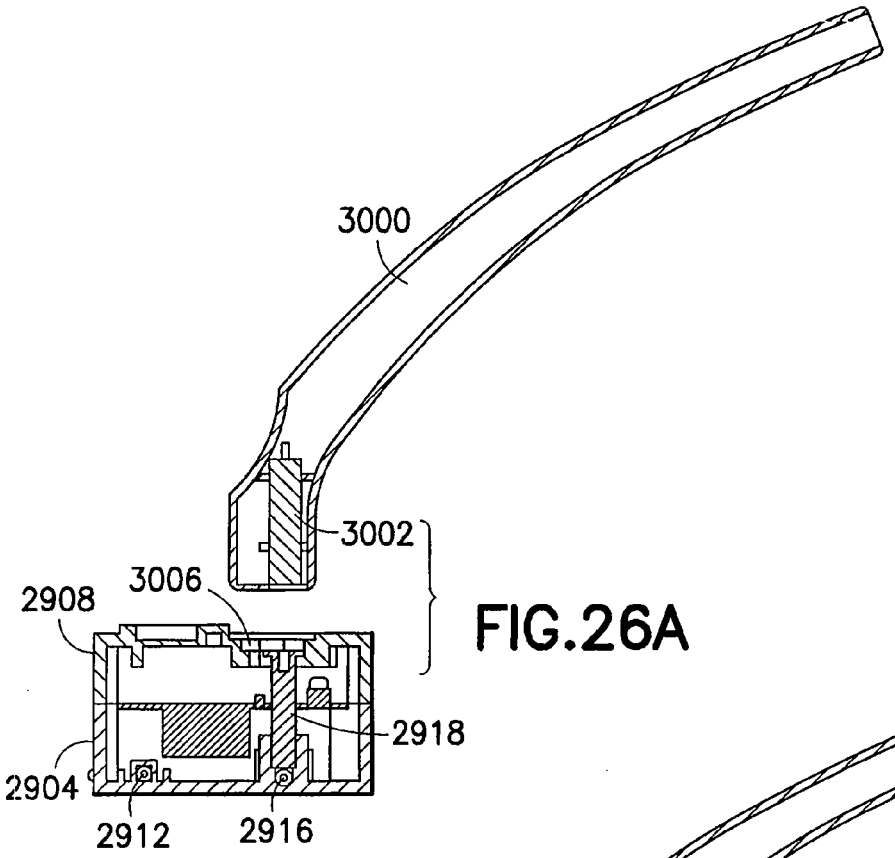
FIGS. 26 A-B illustrate the security tag of FIG. 25 in conjunction with a removal device for use therewith.
Figure 26B:
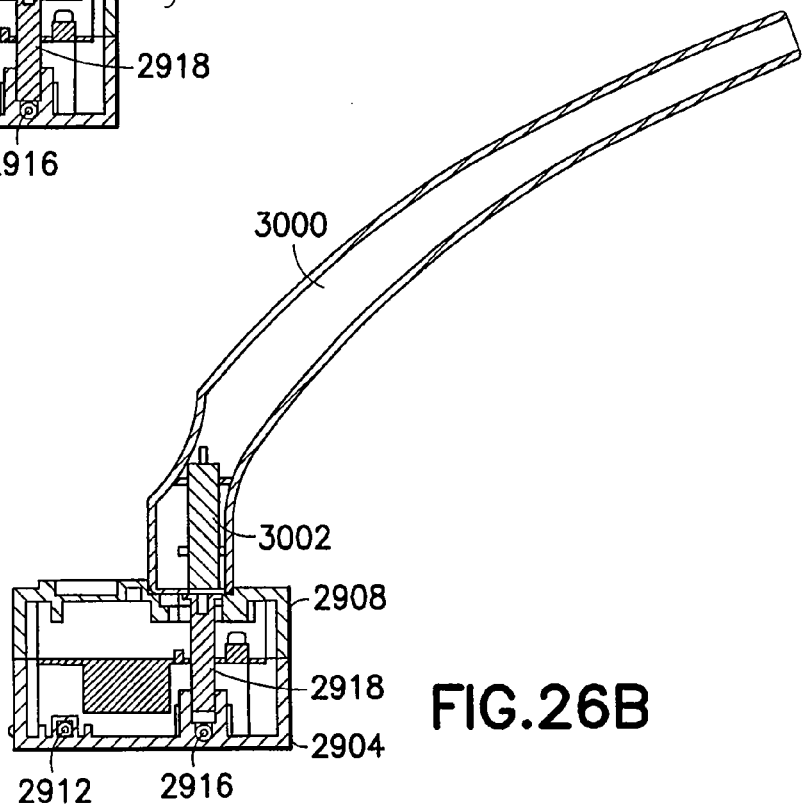

FIGS. 26A-B illustrate a wand 3000 that may be used to deactivate and remove the tag 2900 from merchandise. In FIG. 26A, the tag 2902 is active and the plunger 2916 is locked into the housing 2904. The locking pin 2918 is in contact with the locking notch 2916*a* of the plunger 2916 to lock the plunger to the housing 2906. The wand 3000 is preferably similar to the pen 810 described above and includes a magnet 3002 and one or more electrical contacts (not shown). The electrical contacts preferably provide a deactivation signal which is preferably received via one or more electrical tag contacts (not shown) on the tag 2900.

FIG. 26B illustrates the use of the wand 3000 in removing the tag 2900 from merchandise. More particularly, FIG. 26B illustrates how the wand 3000 may be used to unlock the plunger to allow the tag to be removed from merchandise. The magnet 3002 in the wand 3000 is positioned over the locking pin 2918 and lifts the locking pin 2918 out of the locking recess 2916*a*. Thus, the plunger 2916 can be removed from the housing. The electrical contacts on the wand also contact the electrical tag contacts on the tag 2900 such that the deactivation signal is sent to the controller to deactivate the alarm. The controller deactivates the alarm when it receives the correct deactivation signal. The deactivation signal may be encrypted in order to prevent the use of counterfeit removal devices.

The tag 2900 may further include a recess 3006 formed in a top surface of the cover to indicate the correct position of the wand 3000 to deactivate the alarm and to unlock the plunger.

Although the present invention has been described in relation to particular embodiments thereof, many other variations and modifications and other uses will become apparent to those skilled in the art. It is preferred, therefore, that the present invention be limited not by the specific disclosure herein.

What is claimed is:

1. A security tag comprising:

a housing;

a connecting portion connected to the housing and operable to connect the housing to merchandise to be secured; a magnetic locking mechanism operable to lock the housing to the connecting portion;

a monitoring device operable to monitor whether a party removes or attempts to remove the housing from the connecting portion; and an alarm operable to emit a tamper signal when the monitoring device indicates that a party has removed or attempted to remove the housing from the connecting portion in an unauthorized condition.

2. The security tag of claim 1, wherein the alarm does not emit the tamper signal when the housing is removed or attempted to be removed from the connecting portion in an authorized condition.

3. The security tag of claim 2, wherein the security tag is in the authorized condition when it receives an encrypted deactivation signal to deactivate the alarm.

4. A security system comprising:

a security tag operable for connection to merchandise to be secured; the security tag including a magnetic locking mechanism operable to lock the security tag to the merchandise;

a monitoring device operable to monitor whether a party removes or attempts to remove the security tag from the merchandise; and an alarm operable to emit a tamper signal when the monitoring device indicates that a party has removed or attempted to remove the security tag from the merchandise in an unauthorized condition.

5. The security system of claim 4, wherein the alarm does not emit the tamper signal when the tag is removed or is attempted to be removed from the merchandise in an authorized condition.

6. The security system of claim 5, wherein the security tag is in the authorized condition when it receives an encrypted deactivation signal to deactivate the alarm.

7. The security system of claim 4, wherein the magnetic locking mechanism further comprises at least one locking pin made of a magnetic material, such that the locking pin is movable to open the locking mechanism by a magnet.

8. The security system of claim 7, further comprising a removal device operable to provide the encrypted deactivation signal and to release the magnetic locking mechanism.

9. A security system comprising:

a security tag operable for connection to merchandise to be secured, wherein the security tag includes a first element operatively connected to a second element;

the security tag further including a magnetic locking mechanism operable to lock the first element to the second element;

a monitoring device operable to monitor a relationship between the first element and the second element; and an alarm operable to emit a first alarm signal when the monitoring device indicates that the first element is separated from the second element in an unauthorized condition.

10. The security system of claim 9, wherein the alarm does not emit the first alarm signal when the first element is separated from the second element in an authorized condition.

11. The security system of claim 10, wherein the security system is in an authorized condition when the security tag has received an encrypted deactivation signal to deactivate the alarm.

12. A security system comprising:

a security tag operable for connection to merchandise to be secured, wherein the security tag includes a first element operatively connected to a second element;

the security tag further including a magnetic locking mechanism operable to lock the first element to the second element;

a monitoring device operable to monitor a relationship between the first element and the second element;

an alarm operable to emit a first alarm signal when the monitoring device indicates that the first element is separated from the second element in an unauthorized condition;

a plurality of network readers positioned in predetermined locations, wherein each network reader has a predefined reception range and each network reader is operable to receive wireless signals including the first alarm signal; and a collector connected to each network reader of the plurality of network readers and operable to receive information from the network readers regarding wireless signals received by the network readers for security processing.

13. The security system of claim 12, wherein the alarm does not emit the first alarm signal when the first element is separated from the second element in an authorized condition.

14. The security system of claim 13, wherein the security system is in an authorized condition when the security tag has received an encrypted deactivation signal to deactivate the alarm.

15. A security system comprising:

a security tag operable for connection to merchandise to be secured, wherein the security tag includes a first element operatively connected to a second element;

the first element having an adhesive adapted to connect the first element to the merchandise to be secured;

the security tag further including a locking mechanism operable to lock the first element to the second element;

a monitoring device operable to monitor whether a party removes or attempts to remove the security tag from the merchandise; and an alarm operable to emit a tamper signal when the monitoring device indicates that a party has removed or attempted to remove the security tag from the merchandise in an unauthorized condition.

16. The security system of claim 15, wherein the alarm does not emit the tamper signal when the tag is removed or is attempted to be removed from the merchandise in an authorized condition.

17. The security system of claim 16, wherein the security tag is in the authorized condition when it receives an encrypted deactivation signal to deactivate the alarm.

* * * * *